US012366255B1

(12) United States Patent
Chen

(10) Patent No.: US 12,366,255 B1
(45) Date of Patent: Jul. 22, 2025

(54) NECK HANGING FAN

(71) Applicant: Shenzhen Replay Technology Co., Ltd., Shenzhen (CN)

(72) Inventor: Lifang Chen, Shenzhen (CN)

(73) Assignee: Shenzhen Replay Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/091,373

(22) Filed: Mar. 26, 2025

(30) Foreign Application Priority Data

| | | |
|---|---|---|
| Dec. 18, 2024 | (CN) | 202423126365.7 |
| Feb. 20, 2025 | (CN) | 202520272949.0 |
| Feb. 20, 2025 | (CN) | 202520273089.2 |
| Feb. 20, 2025 | (CN) | 202520273190.8 |
| Mar. 20, 2025 | (CN) | 202520493660.1 |

(51) Int. Cl.
*F04D 29/54* (2006.01)
*F04D 29/64* (2006.01)
*F04D 19/00* (2006.01)

(52) U.S. Cl.
CPC ..... *F04D 29/545* (2013.01); *F04D 29/644* (2013.01); *F04D 19/002* (2013.01)

(58) Field of Classification Search
CPC .... F04D 29/545; F04D 29/644; F04D 19/002; F04D 25/0673; F04D 25/084; F04D 29/4246; A41D 13/0025; F24F 2221/38; A61F 2007/0011; A61F 2007/0067
See application file for complete search history.

(56) References Cited

U.S. PATENT DOCUMENTS

| | | | | |
|---|---|---|---|---|
| 10,578,119 | B2 * | 3/2020 | Lee | A41D 20/005 |
| 11,635,083 | B2 * | 4/2023 | Li | A61F 7/02 415/182.1 |
| 11,703,060 | B1 * | 7/2023 | Song | F04D 25/166 415/60 |
| 12,060,893 | B2 * | 8/2024 | Liu | F25B 21/02 |
| 12,234,834 | B1 * | 2/2025 | Chen | F04D 25/166 |
| 12,281,656 | B1 * | 4/2025 | Zhu | F04D 25/084 |
| 2021/0355960 | A1 * | 11/2021 | Liu | F04D 25/0673 |
| 2021/0368872 | A1 * | 12/2021 | Lee | F04D 25/084 |
| 2022/0235786 | A1 * | 7/2022 | Liu | F04D 29/281 |
| 2024/0102488 | A1 * | 3/2024 | Xie | F04D 29/4246 |
| 2024/0393031 | A1 * | 11/2024 | Chen | F25D 17/06 |
| 2025/0012286 | A1 * | 1/2025 | Xie | F04D 29/60 |

FOREIGN PATENT DOCUMENTS

| | | | |
|---|---|---|---|
| CN | 222121807 | | 12/2024 |
| KR | 20210001758 U | * | 7/2021 |

* cited by examiner

*Primary Examiner* — Eldon T Brockman
(74) *Attorney, Agent, or Firm* — Birchwood IP

(57) ABSTRACT

A neck hanging fan is provided, which includes a neck wearing bracket including side shells located on left and right sides and a rear shell located on a rear side, the rear shell includes a rear air outlet; a fan located at an air inlet port at an end of the side shells; an air duct provided in the side shells, and an internal aperture of the air duct is gradually decreased. A lower side of the air duct is provided with a plurality of first air outlet ports provided along a length direction of the side shells; the air duct further includes a second air outlet port provided at a tail end, and the second air outlet is aligned with the rear shell. The present disclosure has the advantage of optimizing the air duct path to reduce wind loss and noise, thereby improving the comfort of the wearer.

18 Claims, 20 Drawing Sheets

NECK HANGING FAN

CROSS-REFERENCE TO RELATED APPLICATIONS

This application claims priority to Chinese Patent Application No. 202520273190.8, filed on Feb. 20, 2025; Chinese Patent Application No. 202520273089.2, filed on Feb. 20, 2025; Chinese Patent Application No. 202520272949.0, filed on Feb. 20, 2025; Chinese Patent Application No. 202423126365.7, filed on Dec. 18, 2024; and Chinese Patent Application No. 202520493660.1, filed on Mar. 20, 2025; they are hereby incorporated by reference in their entireties.

TECHNICAL FIELD

The present disclosure relates to the field of neck hanging fan technologies, and in particular, to a neck hanging fan.

BACKGROUND

With the popularity of portable electronic devices, the demand for personal cooling devices has significantly increased, especially in outdoor activities, sports, commuting, or office scenarios. Users have high expectations for portable, efficient, and comfortable cooling devices. As an emerging personal cooling device, neck hanging fans have gradually won the favor of the market due to their portability and direct air supply characteristics.

However, the current internal air duct design of neck hanging fans mainly relies on a hollow structure of the neck wearing bracket itself. For example, a neck hanging fan disclosed in CN 202420112981.8 has an air duct formed by an outer shell of the neck wearing bracket. This design suffers from significant wind loss and high noise in practical use, which affects the comfort of the wearer.

SUMMARY

To address the shortcomings of existing technology, a neck hanging fan is provided that optimizes an air duct path to reduce wind loss and noise, thereby improving the comfort of the wearer.

The present disclosure adopts the following technical solution for implementation: a neck hanging fan, including: a neck wearing bracket, which is in an arc shape to fit around a user's neck, two ends of the neck wearing bracket are provided with air inlet ports; and the neck wearing bracket at least includes side shells located on left and right sides and a rear shell located a rear side, where the rear shell includes a rear air outlet;

a fan, which is provided at the air inlet ports at an end of the side shells; the fan includes an outer shell extending along a length direction of the end of the side shells and fan blades provided in the outer shell;

an air duct, which is provided in the side shells and is extended along a length direction of the side shells; an internal aperture cross-section of the air duct is gradually decreased from one side close to the fan to one side away from the fan; the air duct is communicated to the fan and configured to guide airflow generated by the fan;

a lower side of the air duct is provided with a plurality of first air outlet ports provided along the length direction of the side shells, and a side air outlet corresponding to the first air outlet ports is provided on a wall of the side shells; a part of the airflow blows out of the neck wearing bracket through the first air outlet ports and the side air outlet;

the air duct further includes a second air outlet port provided at a tail end, the second air outlet port is aligned with the rear shell, a part of the airflow blows out of the neck wearing bracket through the second air outlet port and the rear air outlet.

This technical solution guides and optimizes the airflow direction through the air duct, thereby reducing wind loss and noise, and improving the comfort of the wearer.

In some embodiments of the present disclosure, the air duct further includes a first branch duct, and the first branch duct is provided in the side shells, located on an upper side of the air duct and communicated to the air duct, where the first branch duct is provided with a first branch duct outlet port that guides an airflow direction to be upward; the first branch duct includes a rear wall extending along a length direction of the air duct, so that an aperture of the first branch duct is gradually increased along the airflow direction.

By providing the first branch duct, the wind can be blown upwards from the first branch duct to expand the cooling coverage range, thereby improving the comfort and user experience of the wearer.

In some embodiments of the present disclosure, the air duct further includes a second branch duct, and the second branch duct is provided in the side shells, located on an inner side of the air duct and communicated with the air duct, the second branch duct is provided with a second branch duct outlet port that guides the airflow direction to an inner side; the second branch duct includes a rear wall extending along the length direction of the air duct, so that an aperture of the second branch duct is gradually increased along the air flow direction.

This technical solution further includes a second branch duct, allowing the neck hanging fan to blow air from multiple angles to cool down multiple areas of the wearer's neck and head. The first air outlet ports can accurately guide the airflow to the lower part of the wearer's neck, providing a basic cooling effect. The first branch duct outlet port can extend the airflow to the upper side of the neck and head, expanding the cooling coverage area. The second branch duct outlet port can evenly distribute the airflow to the middle of the neck, supplement the cooling area, and avoid local overheating. Through this multi-directional diversion design, the airflow can be evenly distributed to the upper, middle, and lower areas of the neck as well as the head, avoiding the problem of airflow concentration on the lower side in traditional designs. This design not only expands the cooling range, but also achieves a comprehensive and uniform cooling effect, thereby improving the comfort and user experience of the wearer.

In some embodiments of the present disclosure, the air duct includes an upper side wall and a lower side wall respectively located on an upper side and a lower side of the air duct, the lower side wall is arranged parallel to an inner wall of the neck wearing bracket, and the upper side wall is inclined relieve to an inner wall of the side shells, a distance between the upper side wall and the lower side wall is gradually decreased along the airflow direction inside the air duct so as to achieve a gradual reduction in the internal aperture of the air duct along its internal airflow direction; a distance between the upper side wall and the upper inner wall of the side shells is gradually increased from one side close to the fan to one side away from the fan so as to form a cavity, and a battery is provided in the cavity.

Due to the fact that the first air outlet ports are designed to ensure basic cooling, its length is usually longer. Therefore, by arranging the lower side wall parallel to the inner wall of the neck wearing bracket, it better meets the exhaust requirements of the side air outlet. Therefore, by tilting the upper side wall and gradually reducing the distance between it and the lower side wall, the internal aperture of the air duct is gradually reduced along its internal airflow direction. And because the distance between the upper wall and the upper inner wall of the neck wearing bracket is gradually increased from one side close to the fan to one side away from the fan, the internal aperture of the air duct can be gradually reduced from one side close to the fan to one side away from the fan. At this time, the battery can be precisely placed in the cavity formed between the upper side wall and the upper inner wall of the neck wearing bracket, which can render an internal structure of the neck wearing bracket more compact.

In some embodiments of the present disclosure, the first branch duct and the second branch duct are both provided at one end of the air duct that is close to the fan.

Arranging both the first and second branch ducts at the end of the air duct that is close to the fan can ensure that wind speed inside the first and second branch ducts is relatively fast.

In some embodiments of the present disclosure, the first branch duct and second branch duct are be integrated with the air duct, a connection between the first branch duct and the air duct is a rounded transition structure; an air guide protrusion extending towards an interior of the air duct is provided at a connection between the rear side wall of the second branch duct and the interior of the air duct; the air guide protrusion is extended along an extension direction of the rear side wall of the second branch duct, the air guide protrusion and the rear side wall of the second branch duct are connected by a smooth transition structure.

The above-mentioned rounded transition setting further avoids turbulence and energy loss of airflow at the connection, ensuring that the airflow can smoothly enter the first branch duct, thereby improving the wind speed and uniformity of the air outlet. Due to the inclined arrangement of the upper side wall of the air duct, and the fact that the first branch duct is located on the upper side wall, there is a height difference between an opening at the connection between the first branch duct and the upper side wall, which is close to the fan and far away from the fan. Therefore, wind can easily enter the first branch duct; as the inner wall of the air duct has a curvature, it is not inclined, so the opening at the connection between the second branch duct and the inner wall does not have a height difference between the end close to the fan and the end far away from the fan. Therefore, wind is usually not easy to enter the second branch duct. Therefore, by providing with a guide protrusion, the guide protrusion can block some of the airflow, rendering it easier for the airflow to enter the second branch duct, and achieve the effect of air outlet from the inside of the neck wearing bracket.

In some embodiments of the present disclosure, an end face of the first branch duct outlet port abuts against an upper inner wall side of the side shells, an end face of the second branch duct outlet port abuts against an inner side wall of the side shells; the end face of first air outlet ports of the air duct abuts against a lower inner side wall of the side shells.

The end face of the first branch duct outlet abuts against the upper inner wall of the neck wearing bracket, the end face of the second branch duct outlet abuts against the inner side wall of the neck wearing bracket, and the end face of the first outlet port abuts against the lower inner wall of the neck wearing bracket. Which can ensure that the first branch duct air outlet port and the second branch duct outlet port, as well as the air flowing out of the first outlet port, can immediately flow out from the side shells to the outside.

In some embodiments of the present disclosure, a lower end of the air duct is provided with an air outlet groove extending along its length direction, a plurality of spaced guide vanes are provided in the air outlet groove, and the guide vanes divide the air outlet groove into a plurality of spaced first air outlet ports; the guide vanes are inclined, and an included angle between the guide vanes and a horizontal plane is 55-60 degree.

By arranging the guide vanes to be titled, the wind can be effectively guided, thereby blowing towards the human body. An optimal air outlet angle can be achieved by tilting the guide vanes at an angle of 55-60 degrees relative to the horizontal plane. The tilt setting of the guide vanes is to guide the upper end of the guide vanes towards the side close to the fan and the lower end that is away from the fan. Where, the horizontal plane refers to a horizontal plane of the neck wearing bracket when worn on the human body.

In some embodiments of the present disclosure, the rear shell is hollow, and an interior of the rear shell is provided with a baffle extending along its length direction, and the baffle divides an inner cavity of the rear shell into an upper cavity and a lower cavity, the second air outlet port of the air duct is aligned with the lower cavity and supplies air to the lower cavity, and the rear air outlet is communicated to the lower cavity; an aperture at a tail end of the lower cavity along the airflow direction is smaller than an aperture at a beginning end of the lower cavity along the airflow direction.

The rear shells are divided into an upper cavity and a lower cavity by a baffle, and only the lower cavity is aligned with the air duct to reduce the aperture of the air duct, thereby ensuring that the wind speed blown out by the rear shell is relatively high and improving the comfort of the wearer during use. And the aperture at the tail end of the lower cavity in the airflow direction is smaller than the aperture at the beginning end of the lower cavity in the airflow direction, which can further reduce the aperture of the lower cavity in the airflow direction, ensuring that the wind can blow to the wearer's neck and improve their comfort during use. The way in which the end aperture of the lower cavity is smaller than the beginning aperture can be by bending the baffle towards the side of the lower cavity to reduce the aperture of the lower cavity, or by changing the thickness of the baffle to reduce the aperture of the lower cavity.

A neck hanging fan, including: a neck wearing bracket, which is in an arc shape to fit around a user's neck; two ends of the neck wearing bracket are provided with air inlet ports; the neck wearing bracket at least includes side shells located on left and right sides and a rear shell located on a rear side, where the rear shell includes a rear air outlet;

a fan, which is provided at the air inlet ports at an end of the side shells; the fan includes an outer shell extending along a length direction of the end of the side shells and fan blades provided in the outer shell;

an outer side of the outer shell is sleeved with a shock absorber sleeve, and the shock absorber sleeve is fixed in the neck wearing bracket and configured for shock-absorbing the fan;

an air duct, which is provided in the side shells and is extended along a length direction of the side shells; an internal aperture cross-section of the air duct is gradually decreased from one side close to the fan to one side away from the fan; the air duct is communicated to the fan and configured to guide airflow generated by the fan;

the air duct includes a plurality of first air outlet ports provided along the length direction of the side shells, and a side air outlet corresponding to the first air outlet ports is provided on a wall of the side shells; a part of the airflow blows out of the neck wearing bracket through the first air outlet ports and the side air outlet;

the air duct further includes a second air outlet port provided at a tail end, and the second air outlet port is aligned with the rear shell, a part of the airflow blows out of the neck wearing bracket through the second air outlet port and the rear air outlet.

This technical solution involves installing a shock absorber sleeve on the outer side of the fan shell, which can provide shock absorption for the fan during high-speed rotation. This can reduce the vibration of the shell and also lower noise, thereby improving the comfort of the wearer during use.

In some embodiments of the present disclosure, one end of the shock absorber sleeve close to the air duct is provided with a ring-shaped connection part extending towards the air duct side, and an end of the air duct is sleeved on the ring-shaped connection part and abuts against an end of the shock absorber sleeve.

The ring-shaped connection part is configured to facilitate the connection between the air duct and the shock absorber sleeve. The connection method between the two can be fixed with glue, threaded, inserted and matched, etc.

In some embodiments of the present disclosure, an outer wall of the shock absorber sleeve is provided with a plurality of annular protrusions uniformly spaced along an axial direction of the shock absorber sleeve.

Further enhance the shock absorption effect of the shock absorber sleeve through the annular protrusions to improve the comfort of the wearer.

In some embodiments of the present disclosure, the shock absorber sleeve is provided with a C-shaped fixing ring, the fixing ring is sleeved on an outer side of the shock absorber sleeve, and the fixing ring is fixedly connected to the neck wearing bracket to fix the shock absorber sleeve and the neck wearing bracket.

The method of fixing the shock absorber sleeve to the neck wearing bracket through the C-shaped fixing ring is simpler. The fixing connection between the C-shaped fixing ring and the neck wearing bracket can be screw fixation, snap fastener fixation, and so on.

In some embodiments of the present disclosure, the side shells are composed of two outer shells that are matched with each other, and the two outer shells clamp and fix the shock absorber sleeve.

The shock absorber sleeve is fixed directly by clamping the two outer shells of the side shells, without the need to screw the shock absorber sleeve, which is simple and convenient.

A neck hanging fan including: a neck wearing bracket, which is in an arc shape to fit around a user's neck; two ends of the neck wearing bracket are provided with air inlet port ports; the neck wearing bracket at least includes side shells located on left and right sides and a rear shell located on a rear side, where the rear shell includes a rear air outlet;

a fan, which is provided at the air inlet ports at an end of the side shells; the fan includes an outer shell extending along a length direction of the end of the side shells and fan blades provided in the outer shell;

an inlet-and-outlet direction of the fan refers to a length direction of the side shells or a rotation axis of the fan pointing towards a front end of the side shells; the outer shell is provided with a grille component;

an air duct, which is provided in the side shells and is extended along the length direction of the side shells; an internal aperture cross-section of the air duct is gradually decreased from one side close to the fan to one side away from the fan; the air duct is communicated to the fan and configured to guide airflow generated by the fan;

the air duct includes a plurality of first air outlet ports provided along the length direction of the side shells, and a side air outlet corresponding to the first air outlet ports is provided on a wall of the side shells; a part of the airflow blows out of the neck wearing bracket through the first air outlet ports and the side air outlet;

the air duct further includes a second air outlet port provided at a tail end, the second air outlet port is aligned with the rear shell, a part of the airflow blows out of the neck wearing bracket through the second air outlet port and the rear air outlet.

This technical solution uses grille components to guide the wind blown out by the fan, rendering the wind generated by fans of the same power more concentrated and improving the comfort of the wearer.

In some embodiments of the present disclosure, the grille assembly includes a first grille and a second grille that are arranged coaxially, the first grille is provided with a plurality of first guide vanes, the second grille is provided with a plurality of second guide vanes, the first guide vanes and the second guide vanes are arranged in a staggered manner along an axial direction.

Through the above settings, the first guide vanes of the first grille guide the air blown out by the fan for the first time when the fan blows air, guiding the wind to enhance the wind speed. Then, the second guide vanes of the second grille guide the wind for the second time, further guiding the wind to enhance the wind speed, rendering the wind generated by the same power fan more concentrated, reducing airflow turbulence and eddies, and thus reducing the noise of the fan to a certain extent. Thereby improving the comfort of the wearer.

In some embodiments of the present disclosure, the number of first guide vanes is less than the number of the second guide vanes, a distance between adjacent two first guide vanes is greater than a distance between adjacent two second guide vanes; an extension direction of the first guide vanes is in a straight line, and the first guide vanes are inclined in the axial direction; an extension direction of the second guide vanes is curved, and the second guide vanes are parallel to the axial direction.

The first guide vanes are extended in a straight line and is inclined in the axial direction for preliminary guidance, to preliminarily regulate the airflow direction; afterwards, the extension direction of the second guide vanes is curved and parallel to the axial direction, which regulates the airflow direction for the second time, allowing the wind to flow along the air duct. Where, the axial direction refers to an axial direction of the fan and grille components.

In some embodiments of the present disclosure, the first grille is closer to the fan than the second grille, the second grille is closer to the air duct than the first grille, and a hemisphere extending towards one side of the air duct is provided at a center of the second grille.

By providing the hemisphere, the hemisphere occupies the space through which wind can pass through, rendering a channel through which wind passes to be narrower and further enhancing windspeed.

Compared with existing technologies, the present disclosure has the advantage of optimizing the air duct path to reduce wind loss and noise, thereby improving the comfort of the wearer.

BRIEF DESCRIPTION OF DRA WINGS

NUMERAL REFERENCE

1—neck wearing bracket; 11—side shell; 12—rear shell; 13—battery; 2—air inlet port; 21—side air outlet; 22—upper air outlet port; 23—inner air outlet port; 24—rear air outlet; 3—air duct; 31—upper side wall; 32—lower side wall; 33—inner wall; 34—first air outlet port; 35—guide vane; 36—second air outlet port; 4—first branch duct; 41—first branch duct rear wall; 42—first branch duct outlet port; 5—second branch duct; 51—second branch duct rear wall; 52—second branch duct outlet port; 53—air guide protrusion; 6—baffle; 61—lower cavity; 62—upper cavity; 7—fan; 71—shock absorber sleeve; 711—annular protrusion; 72—ring-shaped connection part; 73—fan blade; 74—dustproof mesh; 8—shell; 81—first grille; 811—first guide vane; 82—second grille; 821—second guide vane; 83—hemisphere; 9—fixing ring.

DESCRIPTION OF EMBODIMENTS

Below is a further description of the present disclosure based on the accompanying drawings and specific embodiments.

Figure 1:
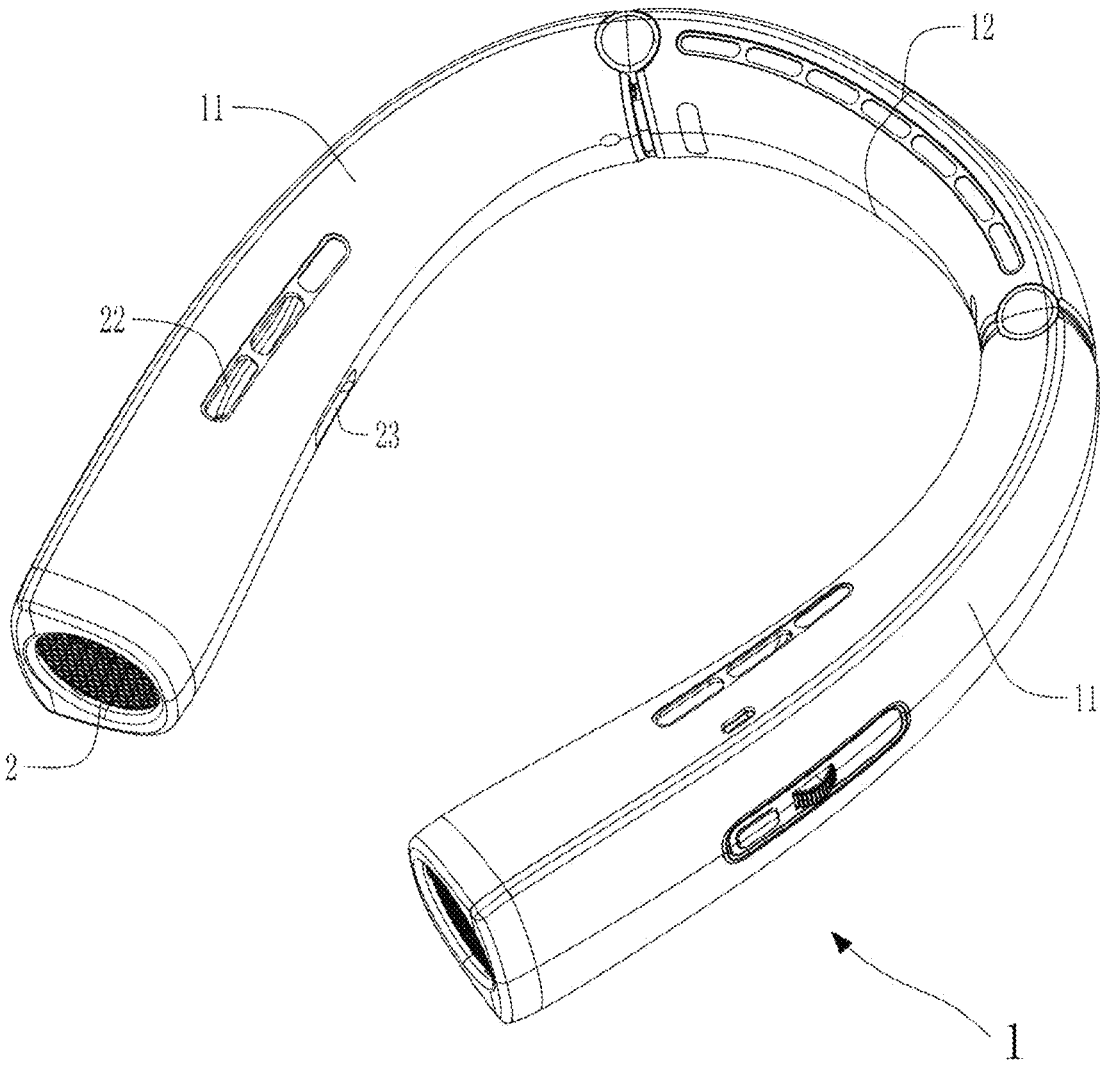
FIG. 1 is a schematic structural diagram of a neck wearing bracket.
Figure 2:
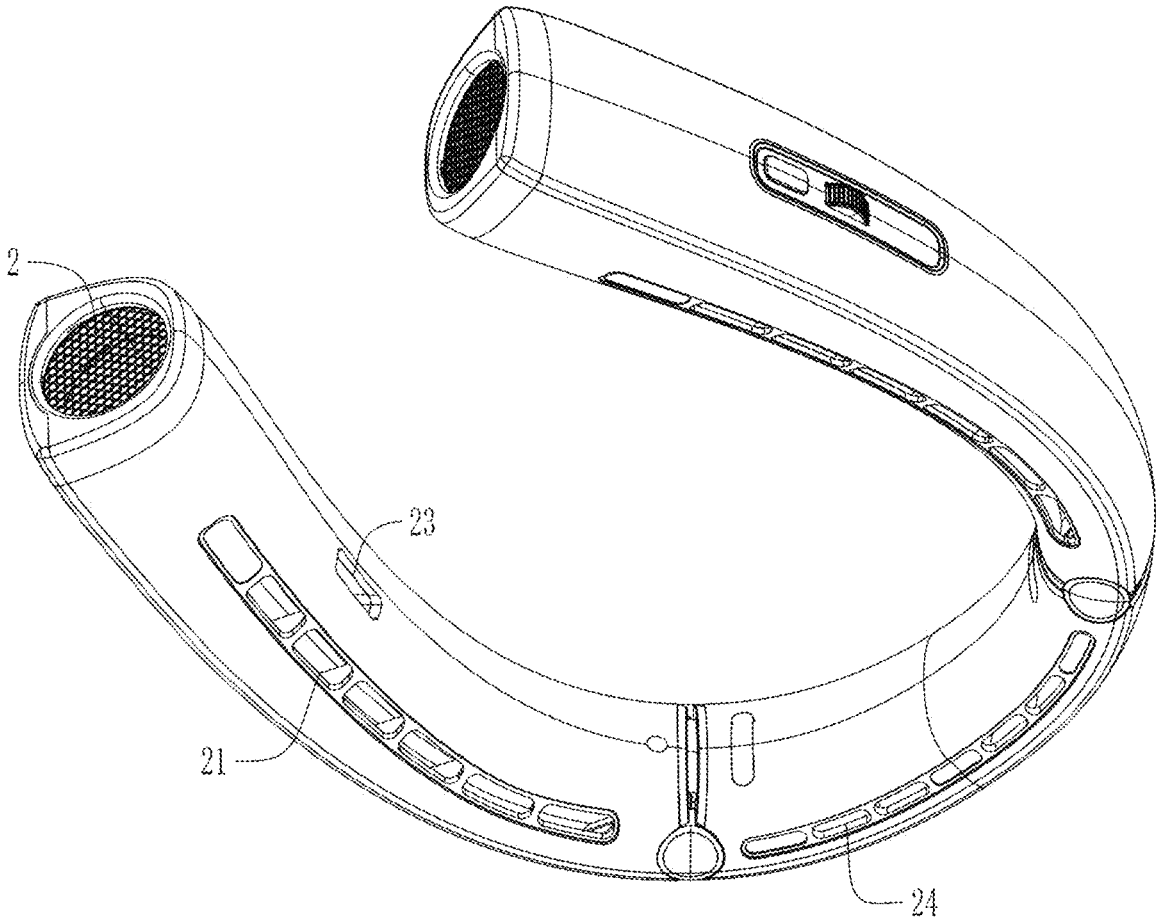
FIG. 2 is a schematic structural diagram of a lower side of the neck wearing bracket.
Figure 3:
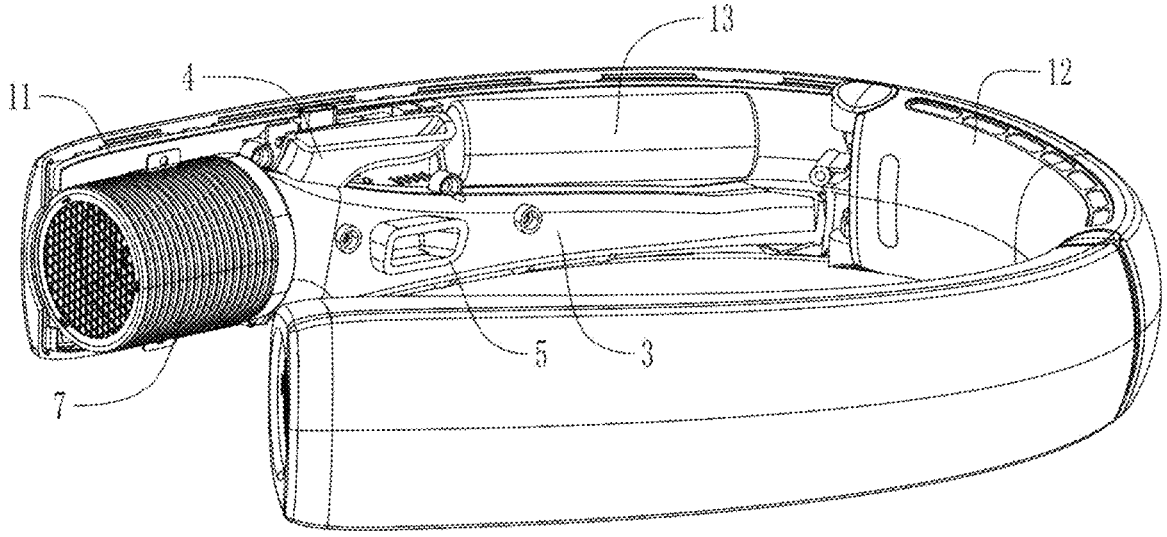
FIG. 3 is a schematic structural diagram of side shells of the neck wearing bracket in FIG. 1 after removing one side shell.
Figure 5:
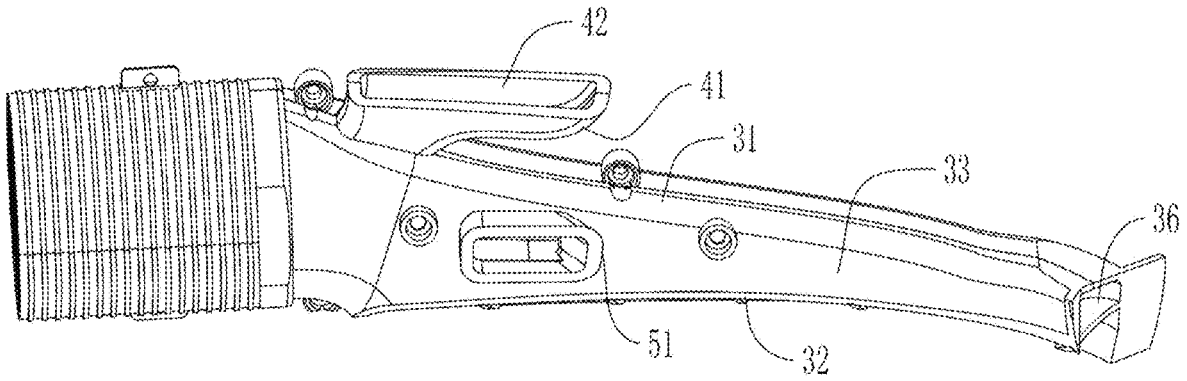
FIG. 5 is a schematic structural diagram of an air duct and a fan.
Figure 6:
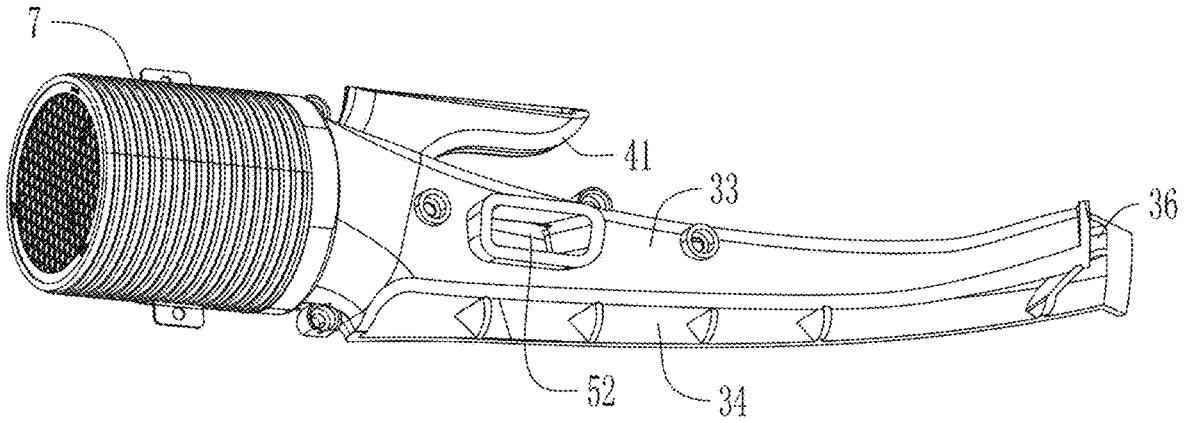
FIG. 6 is a schematic structural diagram of the air duct and fan from another perspective.
Figure 7:
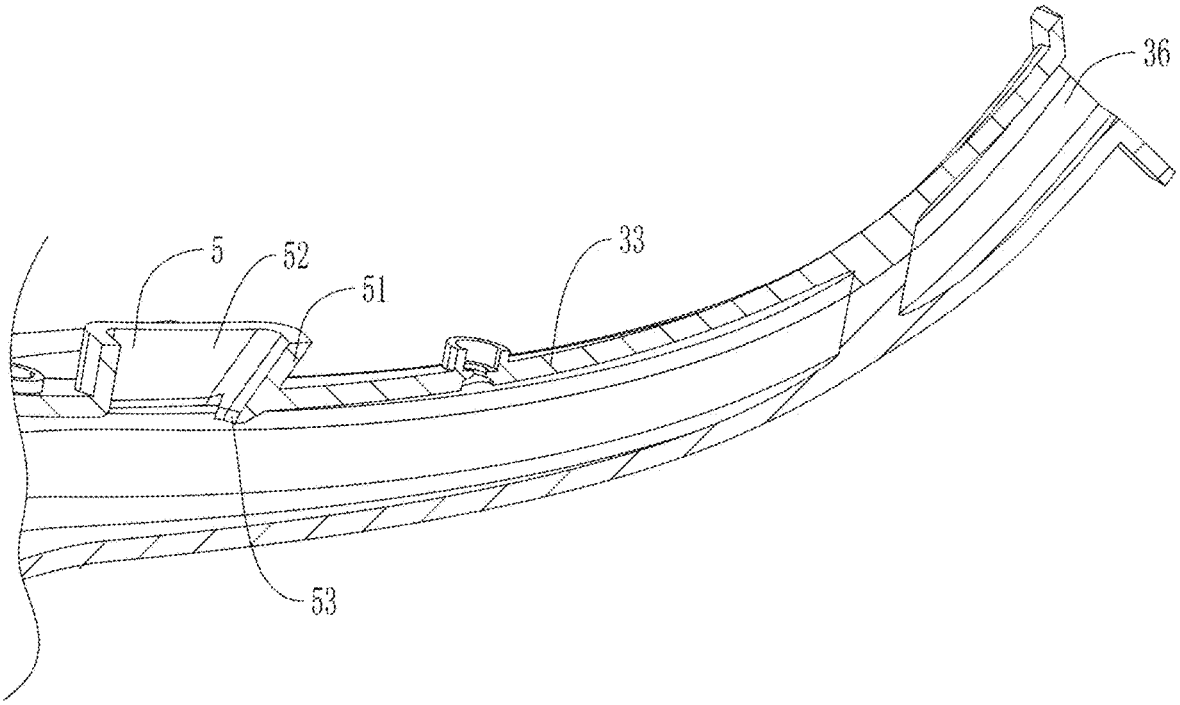
FIG. 7 is a sectional view of a second branch duct.

As shown in FIGS. 1 to 3, this embodiment discloses a neck hanging fan, which includes a neck wearing bracket 1. The neck wearing bracket 1 is arc-shaped as a whole, and the neck wearing bracket 1 includes side shells 11 that make up left and right sections of the neck wearing bracket 1 and a rear shell 12 that makes up a rear section of the neck wearing bracket 1. The two side shells 11 and rear shell 12 are rotatably connected so as to accommodate neck thickness of different wearers. Interiors of the side shells 11 are both provided with a fan 7 and an air duct 3. An end of the side shells 11 is the air inlet port 2, and the fan 7 is provided at the air inlet port 2. The air duct 3 is hollow and is extended along a length direction of the side shells 11. The air duct 3 is communicated to the fan 7 and configured to guide airflow generated by the fan 7. The fan 7 is an existing straight tube fan. [0068] As shown in FIGS. 5 to 7, the air duct 3 includes an upper side wall 31 and a lower side wall 32 located on an upper side and a lower side of the air duct 3, as well as an inner wall 33 located on an inner side of the air duct 3. A distance between the upper side wall 31 and an upper inner wall of the neck wearing bracket 1 is gradually increased from one side closer to the fan 7 to one side away from the fan 7 so as to form a cavity, and the cavity is provided with a battery 13. On the lower side wall 32, first air outlet ports 34 extending along a length direction of the lower side wall 32, and a length of the first air outlet ports 34 are close to a length of the entire air duct 3. The lower side wall 32 is arranged to be parallel to the inner wall of the side shells 11, and the upper side wall 31 is inclined relative to the inner wall of the side shells 11. A distance between the upper side wall 31 and the lower side wall 32 is gradually decreased along the airflow direction inside the air duct 3, in order to achieve a gradual reduction in an internal aperture of the air duct 3 along its internal airflow direction. [0069] A first branch duct 4 is provided on the upper side wall 31, and a second branch duct 5 is provided on the inner wall 33. Both the first branch duct 4 and the second branch duct 5 are provided at one end of the air duct 3 close to the fan 7. The first branch duct 4 is extended upward as a whole and is provided with a first branch duct air outlet port 42 with an upward opening, and the second branch duct 5 is extended inward toward an inner side of the neck waring bracket 1 as a whole and is provided with a second branch duct outlet port 52 with an inward opening. On the lower side wall 32, upper side wall 31, and inner wall 33 of the side shells 11, there are a side air outlet 21, an upper side air outlet port 22, and an inner side air outlet port 23 corresponding to the first air outlet ports 34, first branch duct air outlet port 42, and second branch duct outlet port 52, respectively.

The first branch duct 4 and the second branch duct 5 are designed to be integrated with the air duct. The first branch duct 4 and the second branch duct 5 are respectively provided with a first branch duct rear wall 41 and a second branch duct rear wall 51 facing away from the fan 7 side. The first branch duct rear wall 41 and the second branch duct rear wall 51 are both extended towards a tail end of the air duct 3, so that internal apertures of the first branch duct 4 and the second branch duct 5 are gradually increased along their own airflow direction.

An air guide protrusion 53 extending into an interior of the air duct 3 is provided at a connection between the second branch duct rear wall 51 and an interior of the air duct 3. The air guide protrusion 53 is extended along the extension direction of the second branch duct rear wall 51, and the two are connected by a smooth structure. A connection between the first branch duct 4 and the air duct 3 is connected through a rounded transition structure. [0072] As shown in FIG. 9, an end face of the first branch duct outlet port 42 of the first branch duct 4 abuts against an upper inner wall of the side shells 11, and an end face of the first air outlet ports 34 of the air duct 3 abuts against a lower inner side wall of the side shells 11.

Figure 8:
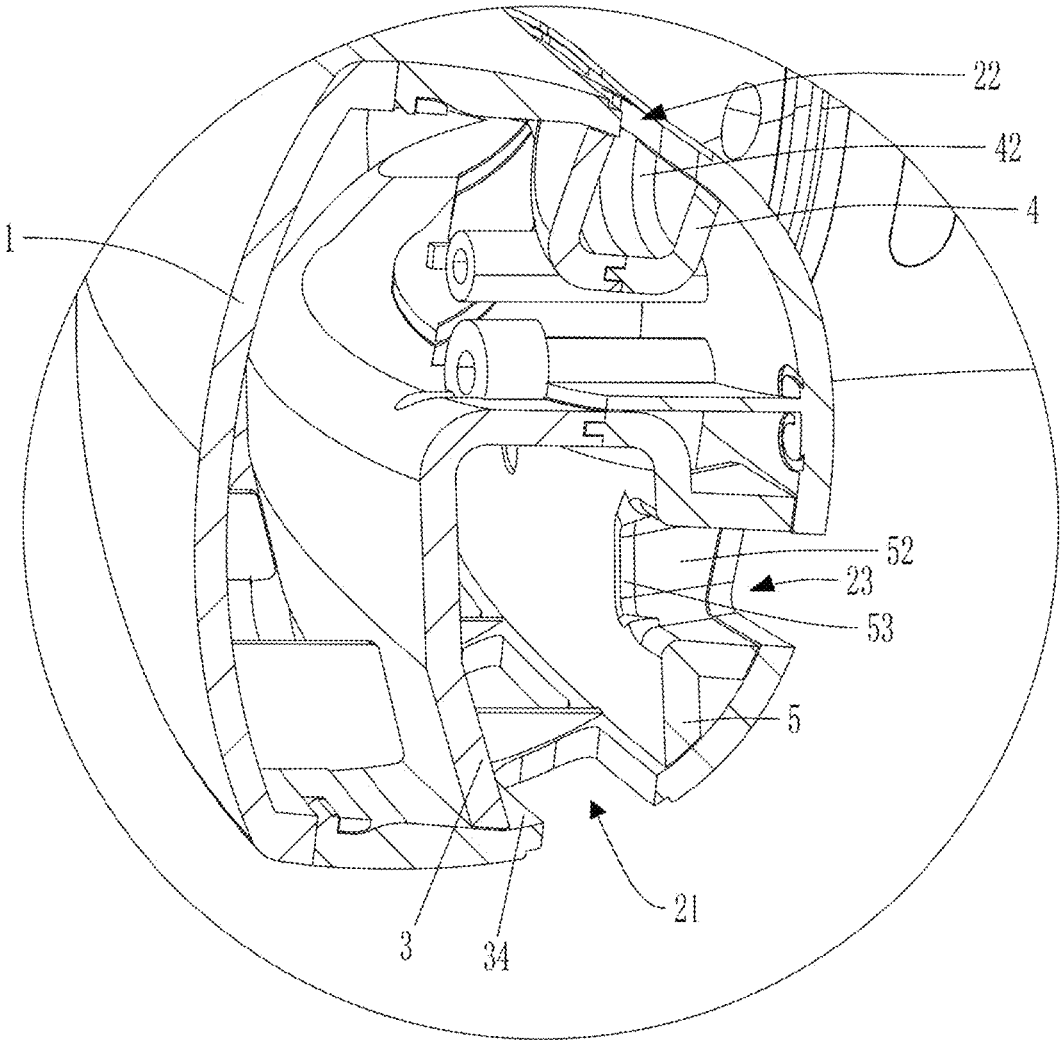
FIG. 8 is a sectional view of the air duct, the first branch duct, and the second branch duct.

As shown in FIG. 8, an end face of the second branch duct outlet port 52 of the second branch duct 5 abuts against an inner side wall of the side shells 11.

Figure 9:
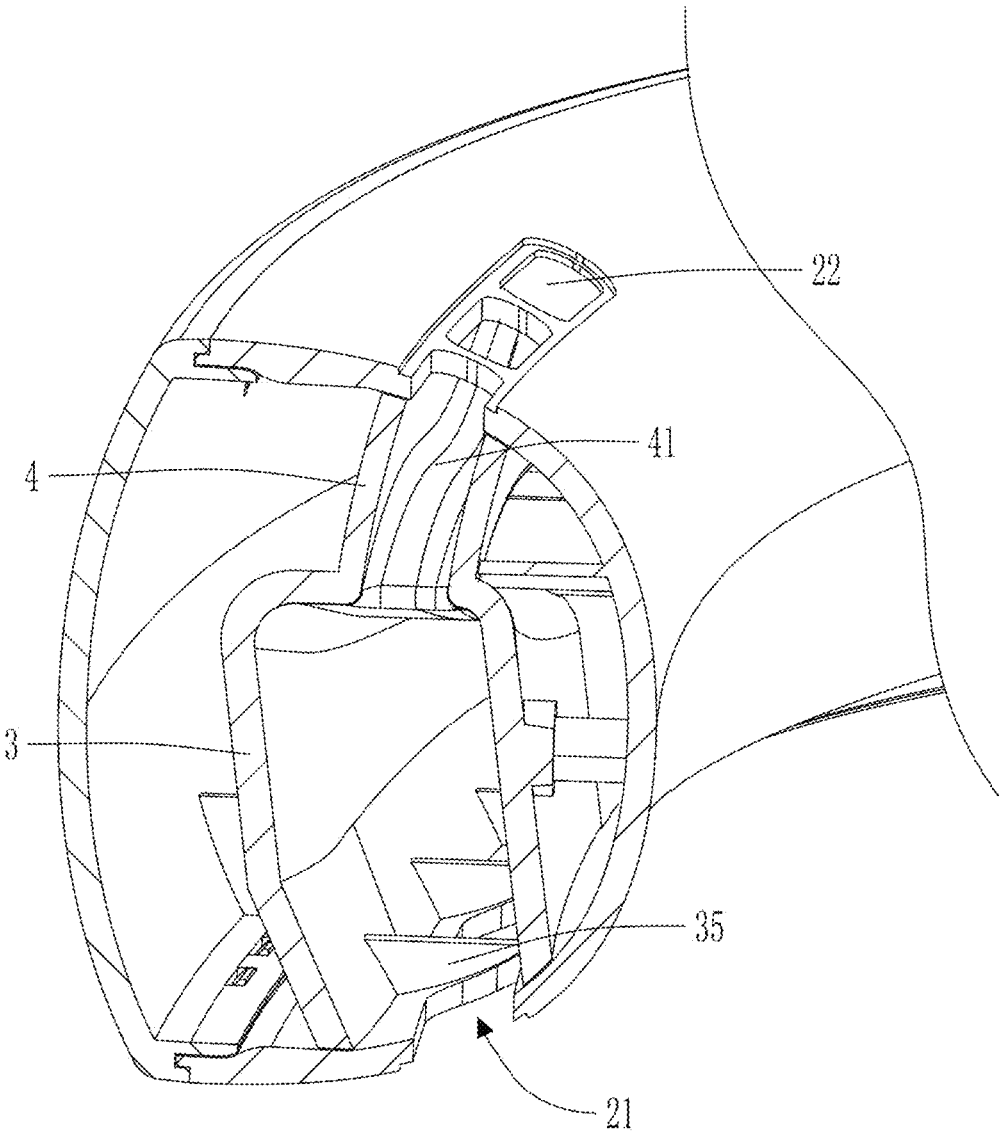
FIG. 9 is a sectional view of the first branch duct and the air duct.
Figure 10:
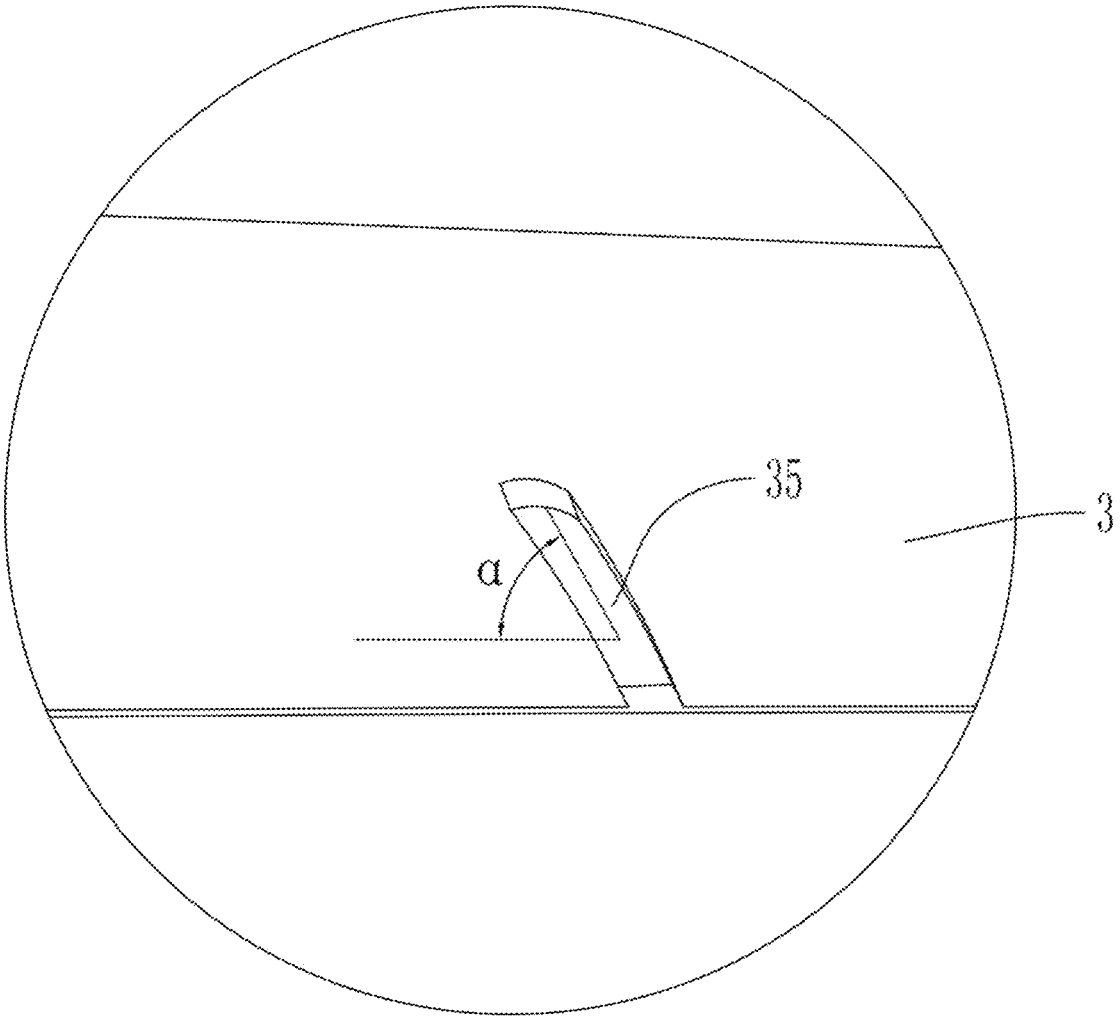
FIG. 10 is a schematic diagram of an angle at guide vanes.
Figure 11:
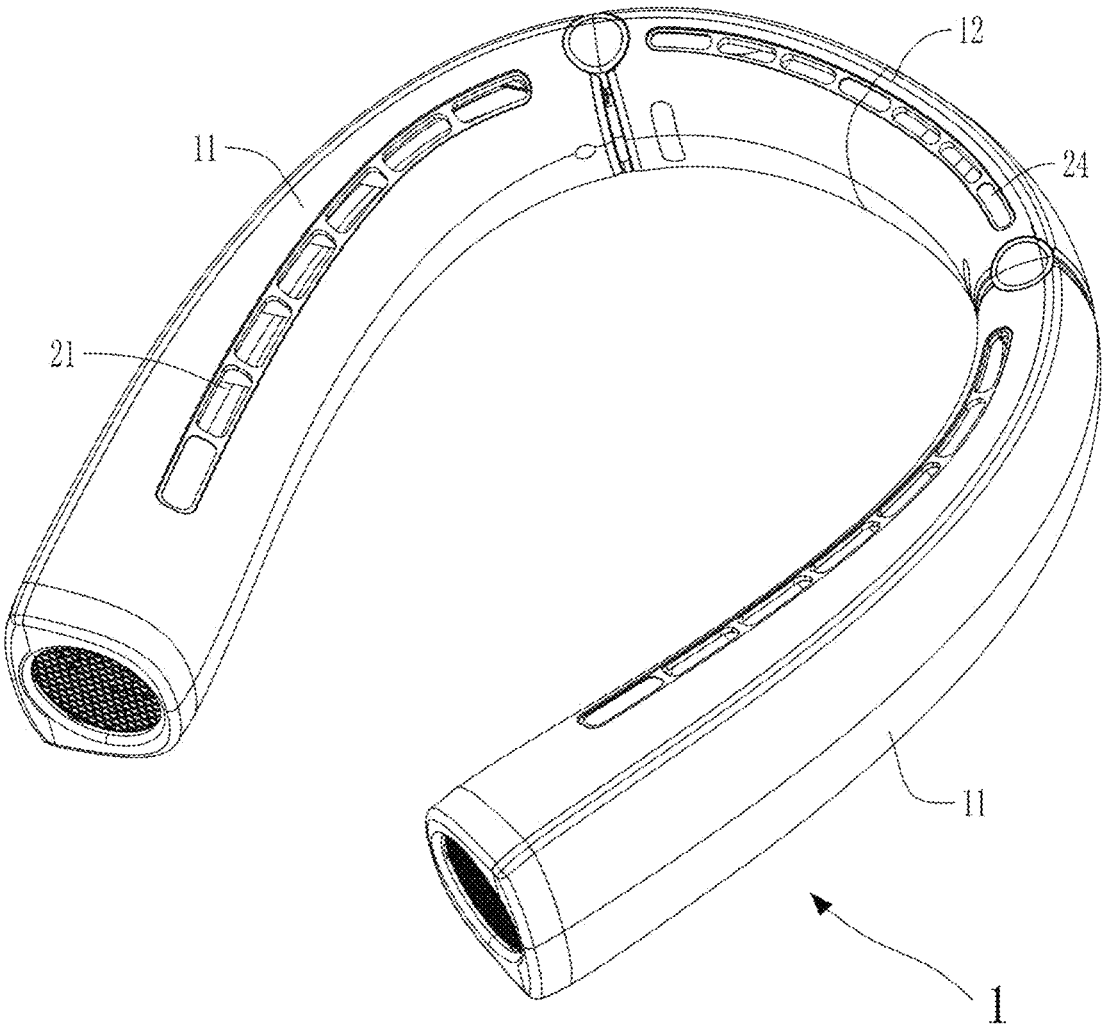
FIG. 11 is a schematic structural diagram of the neck wearing bracket of the neck hanging fan in another embodiment.
Figure 12:
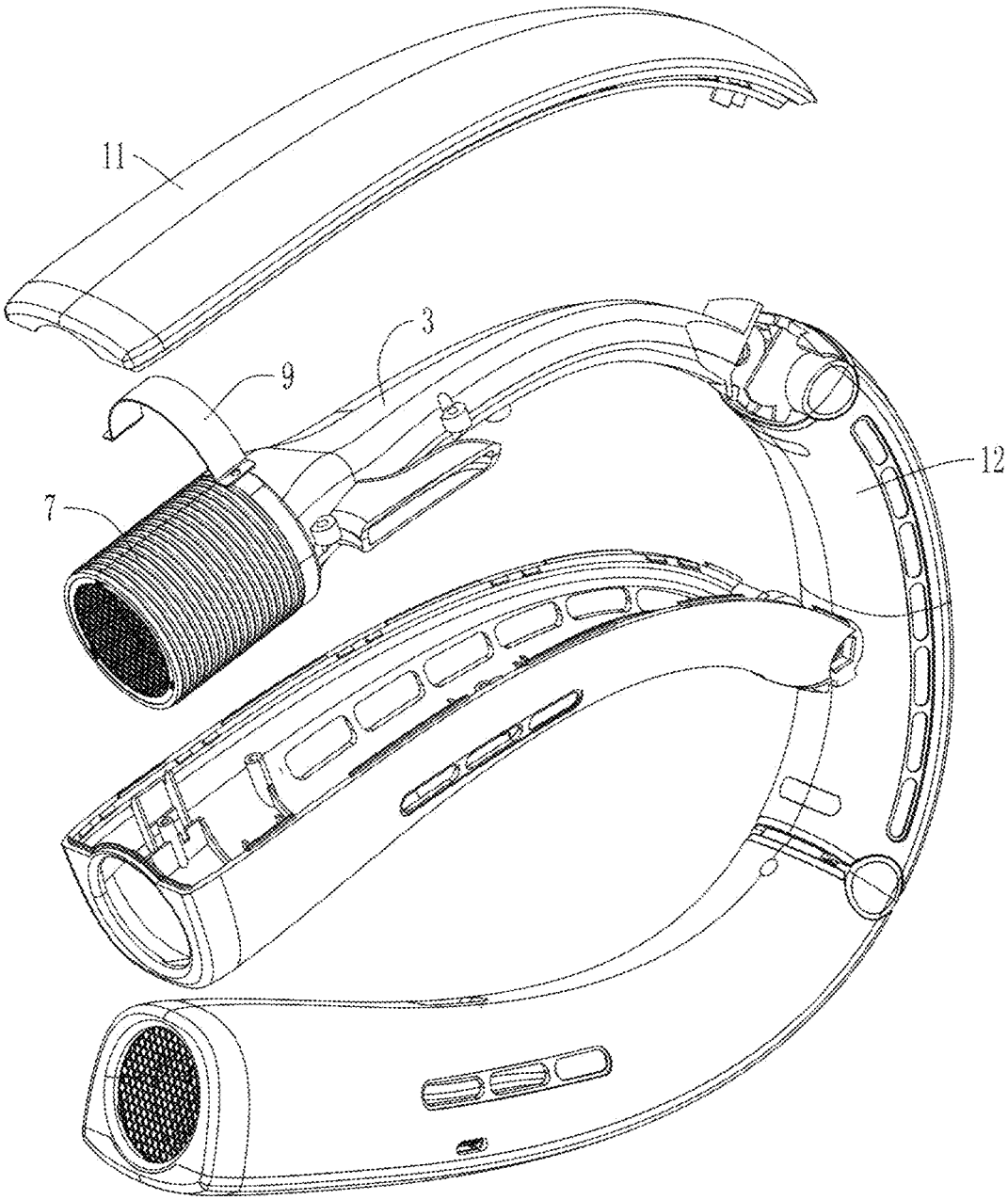
FIG. 12 is an explosion schematic diagram of FIG. 11.
Figure 13:
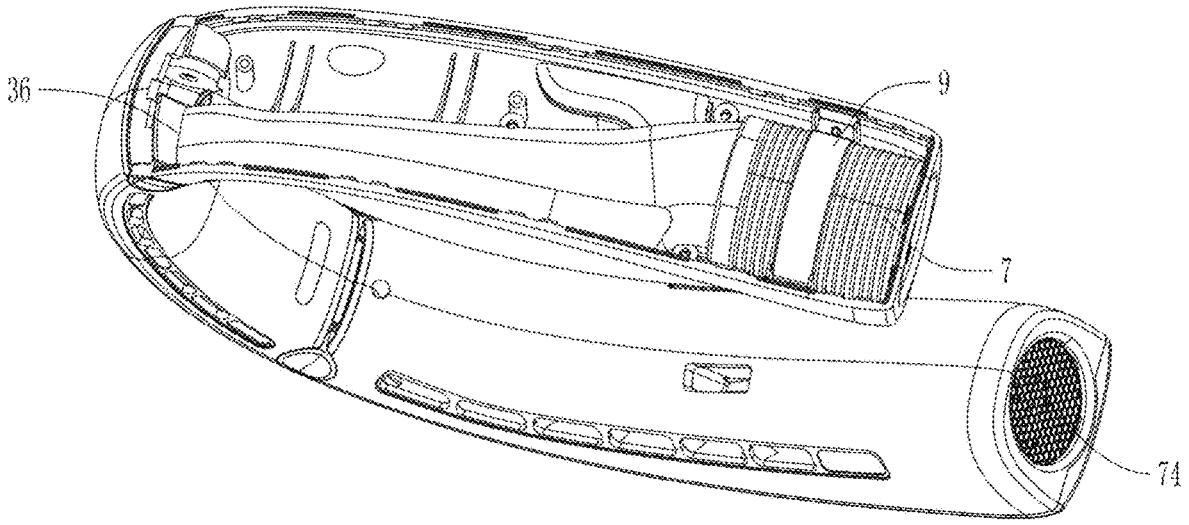
FIG. 13 is a schematic structural diagram of FIG. 11 with one outer shell removed.
Figure 14:
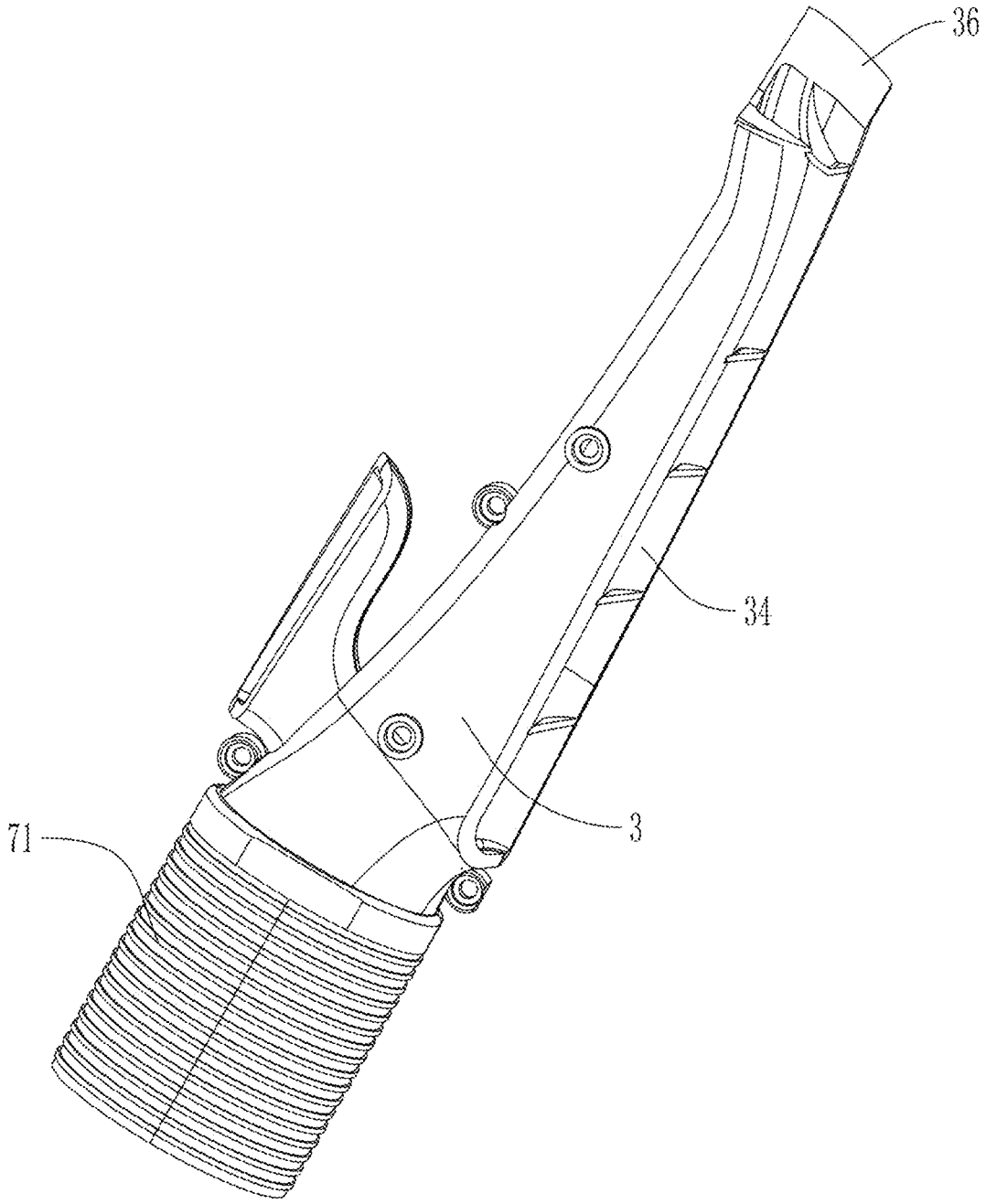
FIG. 14 is a schematic structural diagram of a shock absorber sleeve and air duct of the fan.
Figure 15:
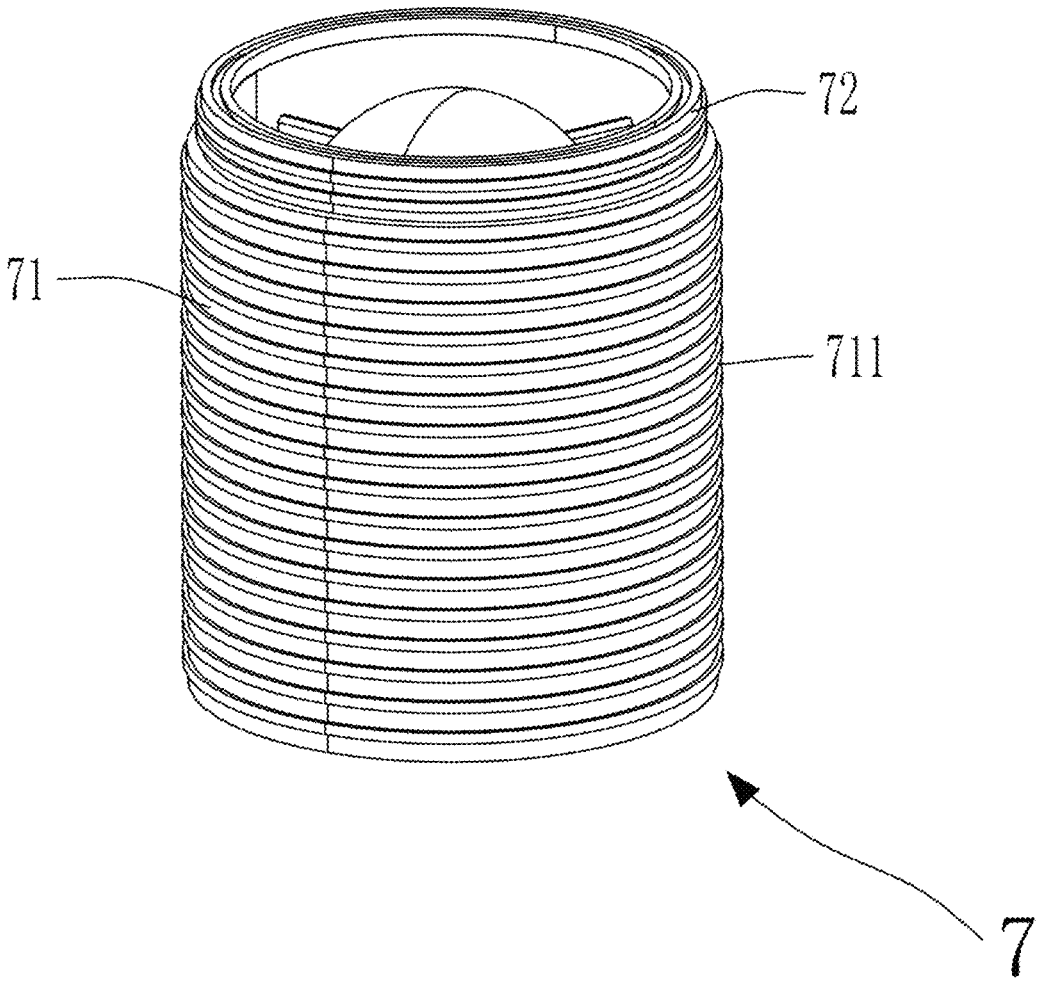
FIG. 15 is a schematic structural diagram of the shock absorber sleeve.
Figure 16:
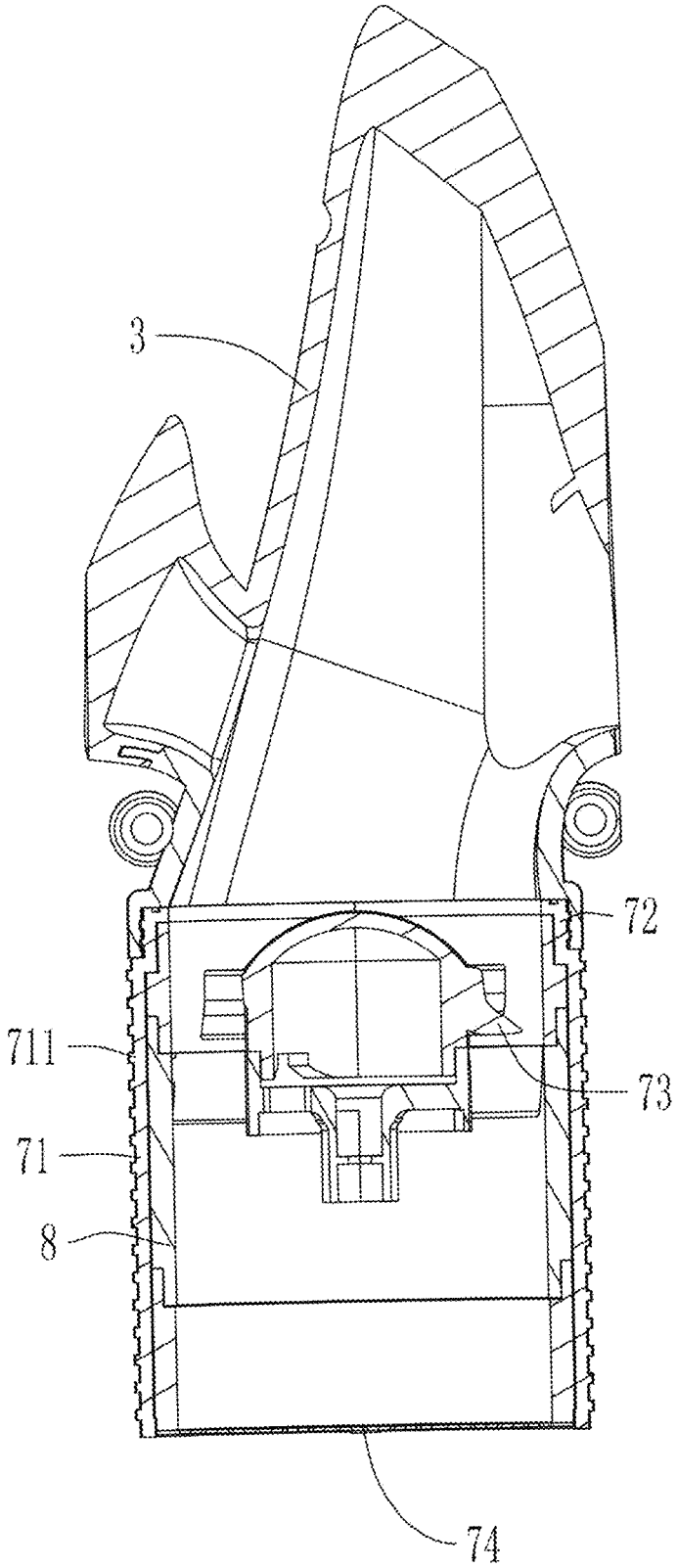
FIG. 16 is a cross-sectional view of FIG. 14.

As shown in FIGS. 9 and 10, a lower end of the air duct 3 is provided with an air outlet groove extending along its length direction. The air outlet groove is provided with a plurality of spaced guide vanes 35, the guide vanes 35 divide the air outlet groove into a plurality of spaced first air outlet ports 34. The guide vanes 35 are inclined, and an angle between the guide vanes 35 and a horizontal plane is a, with an angle of 55-60 degrees.

Figure 4:
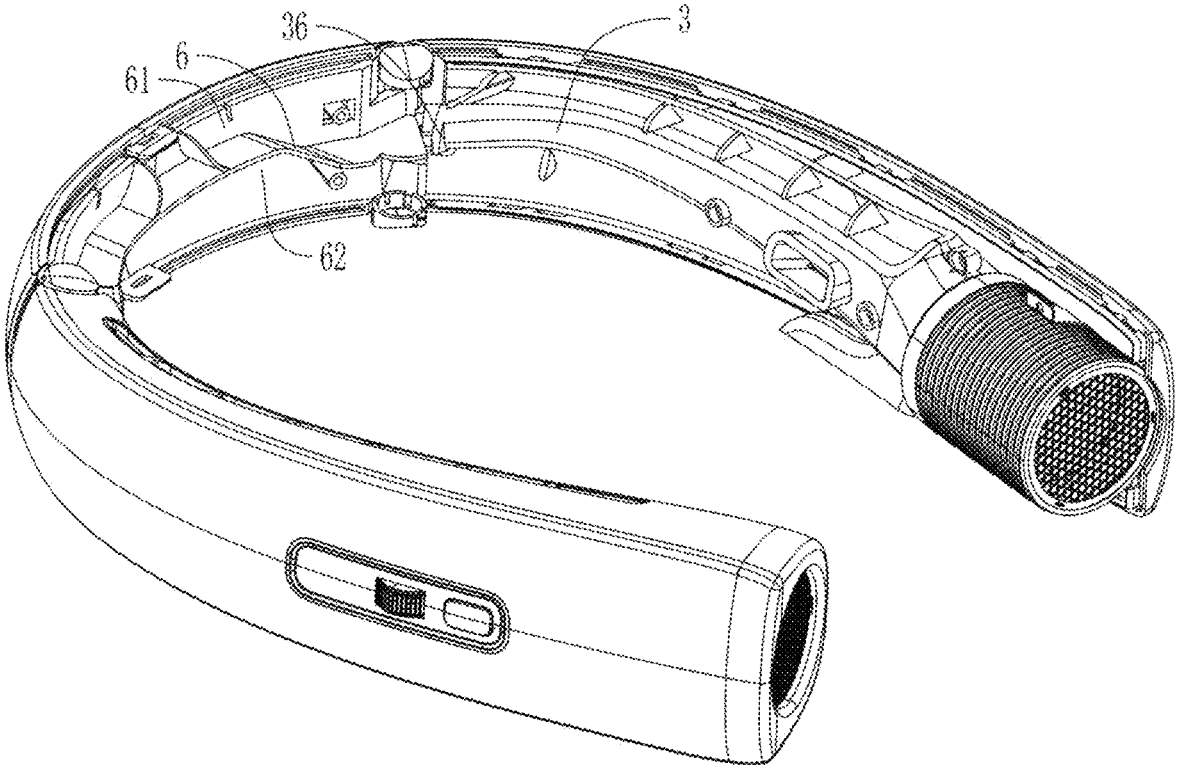
FIG. 4 is a schematic structural diagram of the side shells and a rear shell of the neck wearing bracket after removing one side shell.

As shown in FIGS. 2 and 4, the air duct 3 further includes a second air outlet port 36 provided at a tail end, and the second air outlet port 36 is aligned with the rear shell 12. The rear shell 12 is hollow, and an interior of the rear shell 12 is provided with a baffle 6 that extends along its length and divides an inner cavity of the rear shell 12 into an upper cavity 62 and a lower cavity 61. The second air outlet port 36 at the tail end of the air duct 3 is aligned with the lower cavity 61 and supplies air to the lower cavity 61, thereby forming a rear air duct for guiding the air to the rear neck. There is no wind entering the upper cavity 62. A lower side of the rear shell 12 is provided with a rear air outlet 24 that is communicated with the lower cavity 61, and the air flows out of the neck wearing bracket through the rear air outlet 24. A baffle body of the baffle 6 is arranged to be bent towards the lower cavity 61, so that an aperture at the tail end of the lower cavity 61 along the airflow direction is smaller than an aperture at a beginning end of the lower cavity 61 along the airflow direction.

In an implementation mode, as shown in FIGS. 11 to 16, a neck hanging fan includes a neck wearing bracket 1. The neck wearing bracket 1 is arc-shaped as a whole, and the neck wearing bracket 1 includes side shells 11 that make up left and right sections of the neck wearing bracket 1, and a rear shell 12 that makes up a rear section of the neck wearing bracket 1. The two side shells 11 and the rear shell 12 are rotatably connected to accommodate neck thickness of different wearers. Interiors of the side shells 11 are both provided with a fan 7 and an air duct 3. An end of the side shells 11 is the air inlet port 2, and the fan 7 is provided at the air inlet port 2. The air duct 3 is hollow and is extended along a length direction of the side shells 11. The air duct 3 is communicated to the fan 7 and configured to guide airflow generated by the fan 7. A cross-sectional area of an internal aperture of the air duct 3 is gradually decreased along its internal airflow direction.

A plurality of first air outlet ports 34 are provided along the length direction of the side shells 11 on a lower side of the air duct 3. A side air outlet 21 corresponding to the first air outlet ports 34 is provided on a wall of the side shells 11. A part of the airflow can be blows out of the neck wearing bracket 1 through the first air outlet ports 34 and the side air outlet 21. The air duct 3 further includes a second air outlet port 36 provided at a tail end, and the second air outlet port 36 is aligned with the rear shell 12. The rear shell 12 is provided with a rear air outlet 24 that enables air to be discharged to an outer side of the neck wearing bracket 1.

The fan 7 is a straight tube fan, and the fan 7 includes a shell 8 extending along a length direction of an end of the side shells 11, as well as fan blades 73 and a motor (not shown in the figure) that drives the fan blades 73 to rotate inside the shell 8, and a dustproof mesh 74 provided at an end of the shell 8. A shock absorber sleeve 71 made of silicone material is sleeved on an outer side of the shell 8. A ring-shaped connection part 72 extending towards the air duct 3 is provided at one end of the shock absorber sleeve 71 close to the air duct 3. The ring-shaped connection part 72 is integrally formed with the shock absorber sleeve 71, and a connection between the two forms a step that can abut against the air duct 3. One end of the air duct 3 is sleeved on the ring-shaped connection part 72 and abuts against the end of the shock absorber sleeve 71, so that the air generated by the fan 7 flows into the air duct 3 uniformly. A plurality of annular protrusions 711 evenly spaced along an axial direction of the shock absorber sleeve 71 are provided on an outer wall of the shock absorber sleeve 71.

The shock absorber sleeve 71 is provided with a C-shaped fixing ring 9, and the C-shaped fixing ring 9 is provided on an outer side of the shock absorber sleeve 71. The fixing ring 9 is fixedly connected to the neck wearing bracket 1 by screwing to achieve a fixed connection between the shock absorber sleeve 71 and the side shells 11. In an implementation mode, the side shells 11 are composed of two shells that are matched with each other, so the two shells of the side shells 11 can directly clamp the shock absorber sleeve 71 to achieve fixation of the shock absorber sleeve 71.

Figure 17:
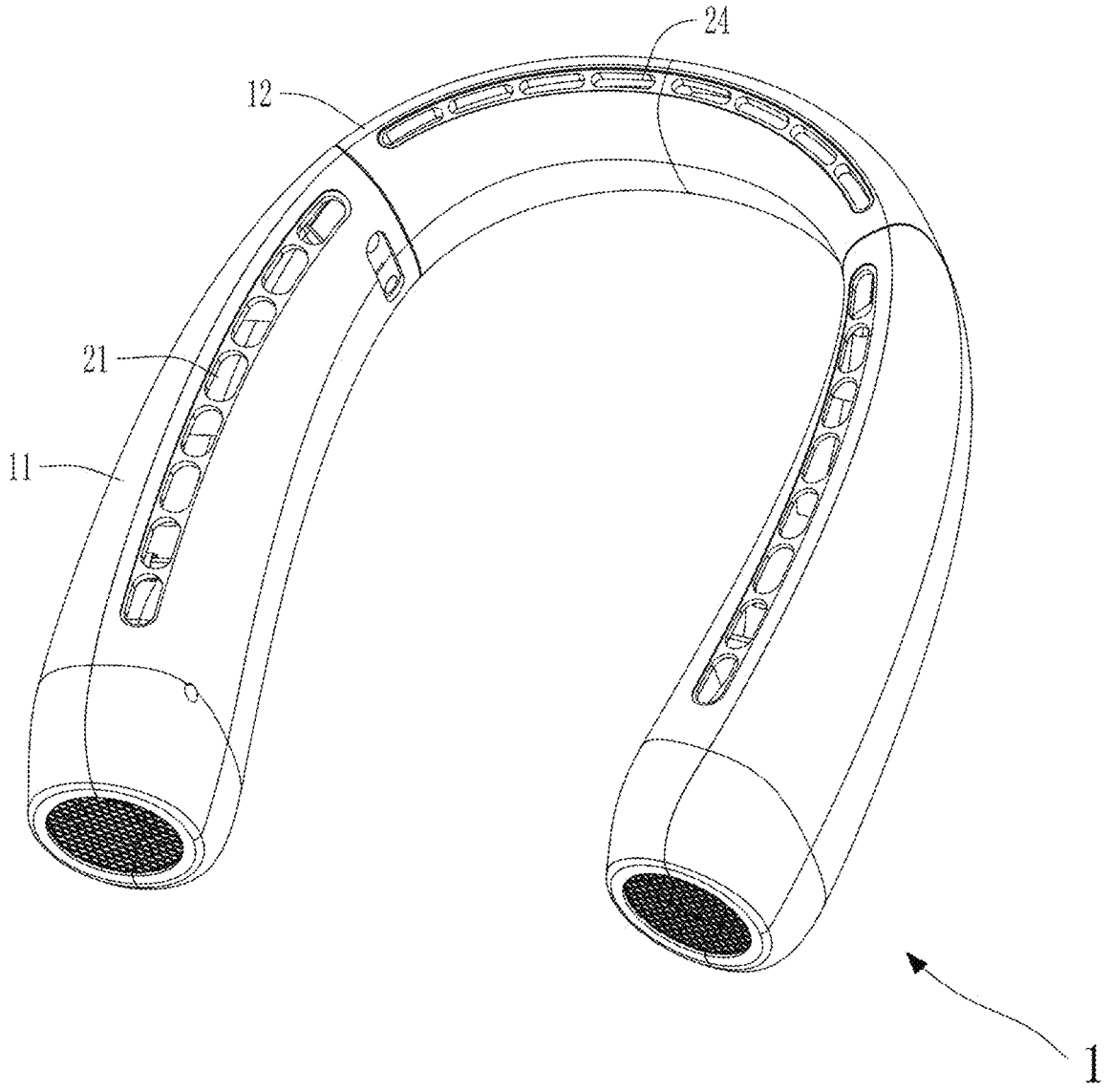
FIG. 17 is a schematic structural diagram of the neck wearing bracket of the neck hanging fan in a third embodiment.
Figure 18:
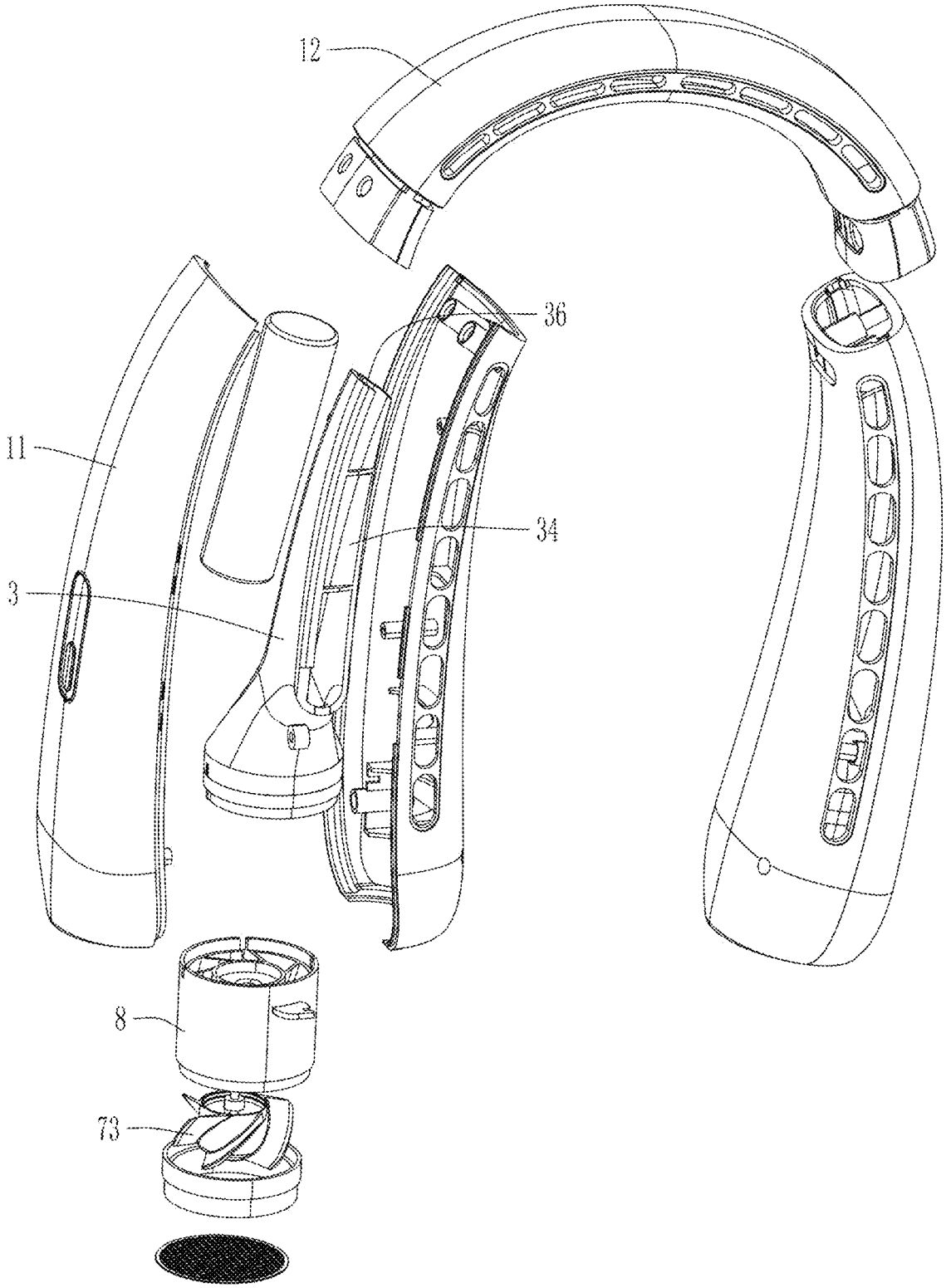
FIG. 18 is an explosion schematic diagram of FIG. 17.
Figure 19:
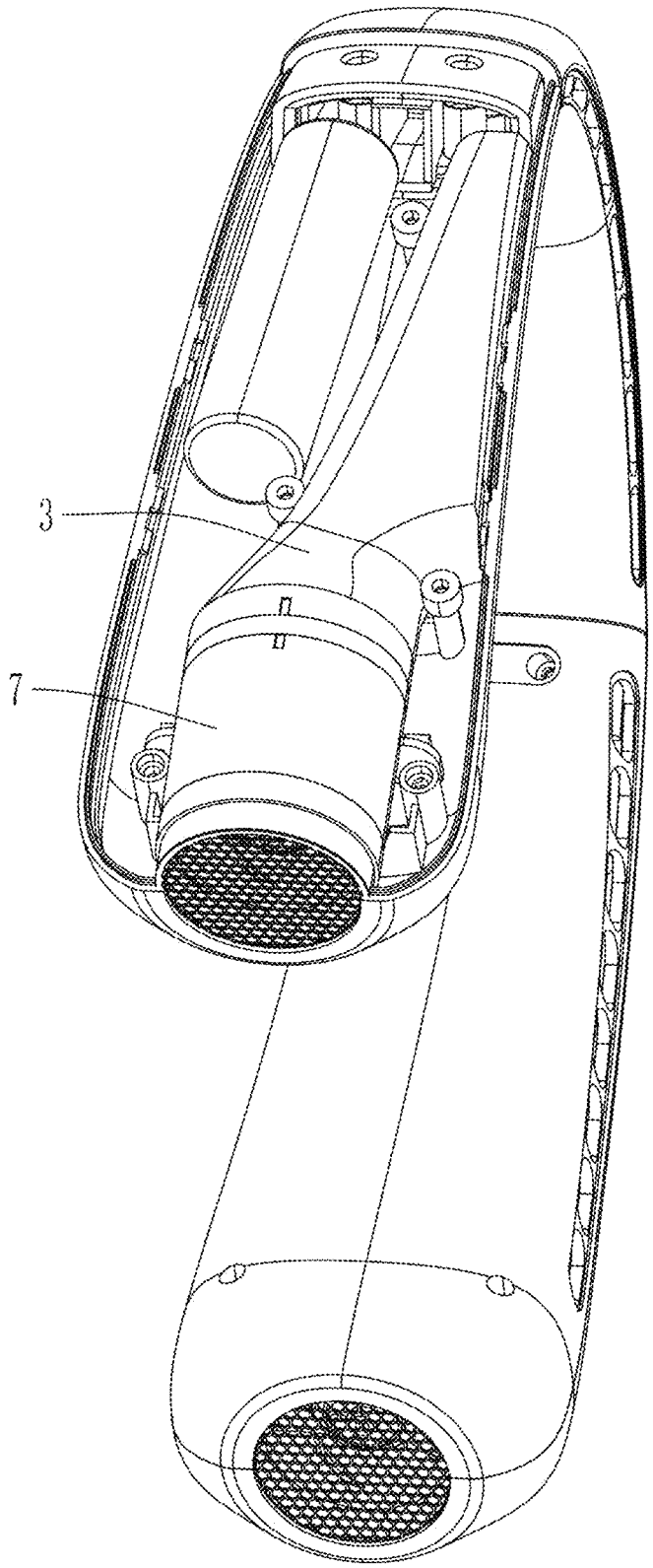
FIG. 19 is a schematic structural diagram of FIG. 17 with one outer shell removed.
Figure 20:
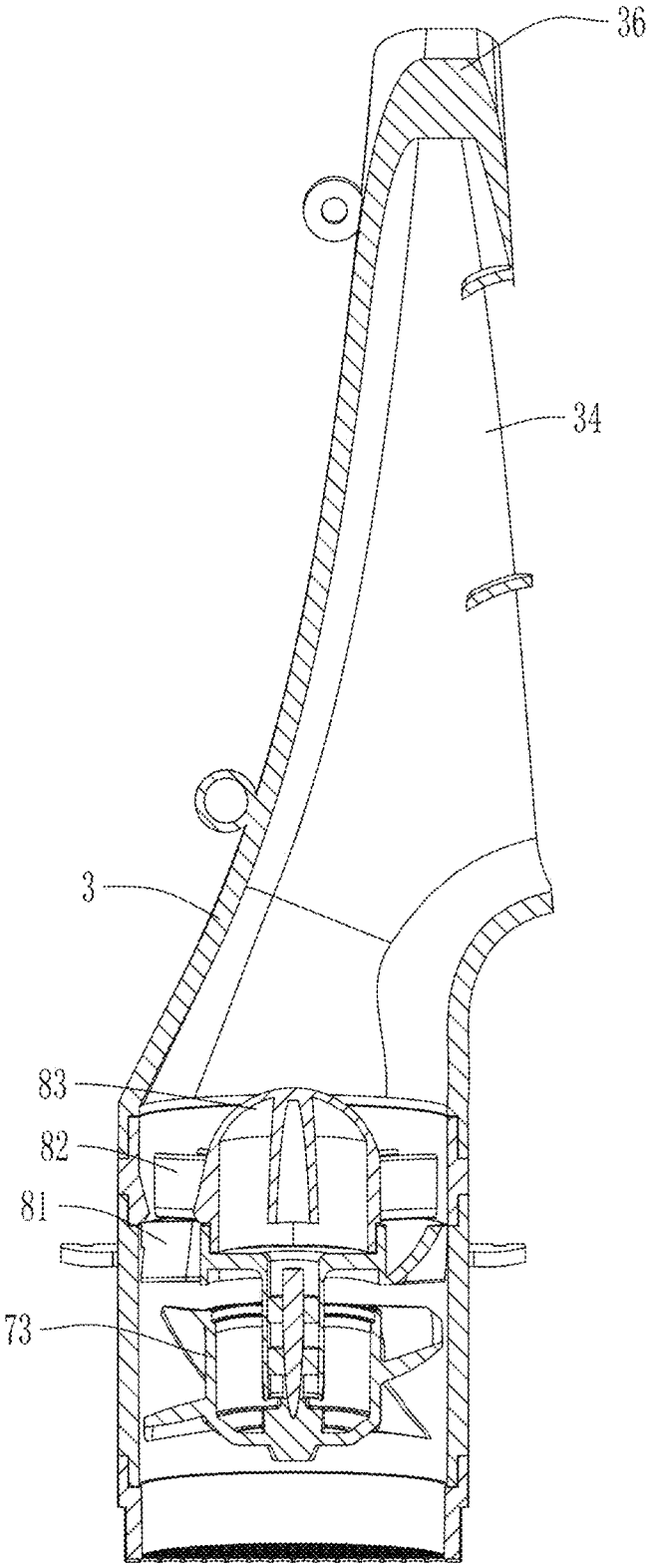
FIG. 20 is a sectional view of the fan and air duct.
Figure 21:
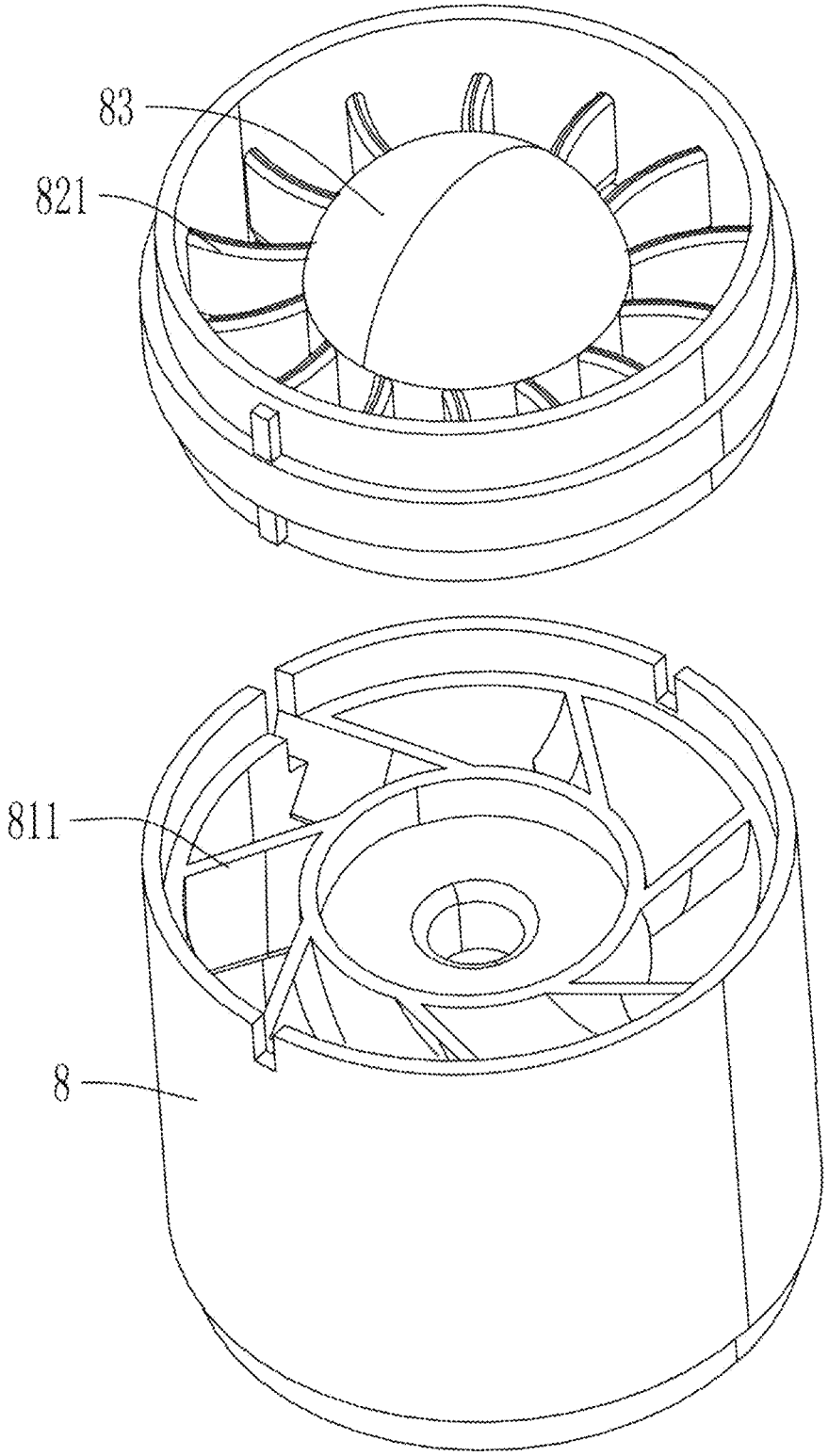
FIG. 21 is a schematic structural diagram of a grille component.
Figure 22:
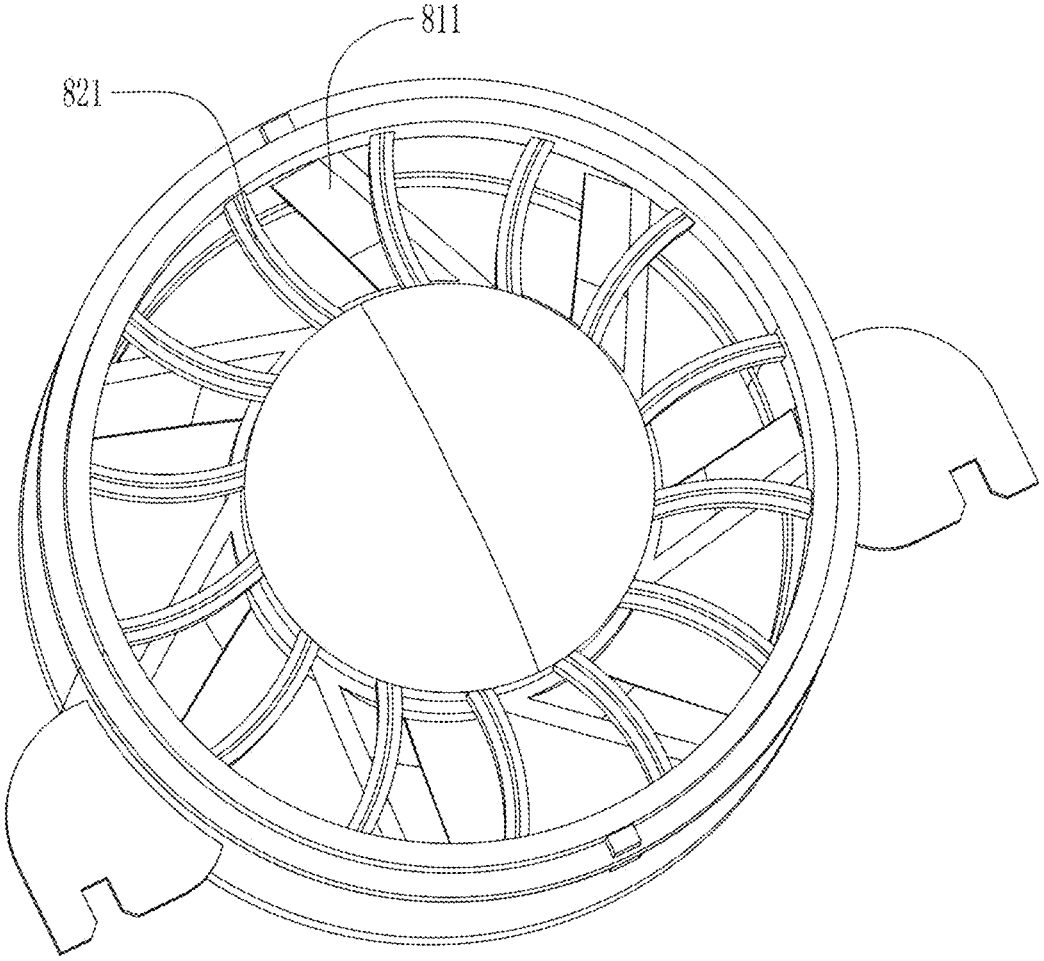
FIG. 22 is a top view of the grille component.

In an implementation mode, as shown in FIGS. 17 and 22, a neck hanging fan includes a neck wearing bracket 1. The neck wearing bracket 1 is arc-shaped as a whole, and the neck wearing bracket 1 includes side shells 11 that make up left and right sections of the neck wearing bracket 1, and a rear shell 12 that makes up a rear section of the neck wearing bracket 1. Interiors of the side shells 11 are both provided with a fan 7 and an air duct 3. An end of the side shells 11 is the air inlet port 2, and the fan 7 is provided at the air inlet port 2. The air duct 3 is hollow, and is extended along a length direction of the side shells 11. The air duct 3 is communicated to the fan 7 and configured to guide airflow generated by the fan 7. A cross-sectional area of an internal aperture of the air duct 3 is gradually decreased along its internal airflow direction.

A plurality of first air outlet ports 34 are provided along the length direction of the side shells 11 on a lower side of the air duct 3. A side air outlet 21 corresponding to the first air outlet ports 34 is provided on a wall of the side shells 11. A part of the airflow can be blows out of the neck wearing bracket 1 through the first air outlet ports 34 and the side air outlet 21. The air duct 3 further includes a second air outlet port 36 provided at a tail end, and the second air outlet port 36 is aligned with the rear shell 12. The rear shell 12 is provided with a rear air outlet 24 that enables air to be discharged to an outer side of the neck wearing bracket 1.

A rotational axis of the fan 7 is pointed towards a front end of the side shells 11, a grille component is provided in the shell 8 of the fan 7. The grille component includes a first grille 81 and a second grille 82 that are arranged in sequence along an axial direction, the first grille 81 and the second grille 82 are arranged adjacent to each other along the axial direction. The first grille 81 is closer to the fan blades 73 of the fan 7 than the second grille 82, and the second grille 82 is closer to the air duct 3 than the first grille 81. At a center of the second grille 82, there is a hemisphere 83 extending towards the air duct 3.

The first grille 81 is provided with a plurality of first guide vanes 811 that are arranged at uniform intervals in a circular shape, and the second grille 82 is provided with a plurality of second guide vanes 821 that are arranged at uniform intervals in a circular shape. The first guide vanes 811 and the second guide vanes 821 are arranged alternately in the axial direction. The number of the first guide vanes 811 is less than the number of the second guide vanes 821, and a distance between adjacent two first guide vanes 811 is greater than a distance between adjacent two second guide vanes 821. The first guide vanes 811 and the second guide vanes 821 are arranged alternately in the axial direction. An extension direction of the first guide vanes 811 of the first grille 81 is in a straight line, and the first guide vanes 811 are inclined with an angle to the axial direction. An extension direction of the second guide vanes 821 of the second grille 82 is curved, and the second guide vanes 821 are arranged parallel to the axial direction without any angle with the axial direction.

What is claimed is:

1. A neck hanging fan, comprising:

a neck wearing bracket, which is in an arc shape to fit around a user's neck, two ends of the neck wearing bracket are provided with air inlet ports; and the neck wearing bracket at least comprises side shells located on left and right sides and a rear shell located a rear side, wherein the rear shell comprises a rear air outlet;

a fan, which is provided at the air inlet ports at an end of the side shells; the fan comprises an outer shell extending along a length direction of the end of the side shells and fan blades provided in the outer shell;

an air duct, which is provided in the side shells and is extended along a length direction of the side shells; an internal aperture cross-section of the air duct is gradually decreased from one side close to the fan to one side away from the fan; the air duct is communicated to the fan and configured to guide airflow generated by the fan;

a lower side of the air duct is provided with a plurality of first air outlet ports provided along the length direction of the side shells, and a side air outlet corresponding to the first air outlet ports is provided on a wall of the side shells; a part of the airflow blows out of the neck wearing bracket through the first air outlet ports and the side air outlet;

the air duct further comprises a second air outlet port provided at a tail end, the second air outlet port is aligned with the rear shell, a part of the airflow blows out of the neck wearing bracket through the second air outlet port and the rear air outlet.

2. The hanging neck fan according to claim 1, wherein the air duct further comprises a first branch duct, and the first branch duct is provided in the side shells, located on an upper side of the air duct and communicated to the air duct, wherein the first branch duct is provided with a first branch duct outlet port that guides an airflow direction to be upward;

the first branch duct comprises a rear wall extending along a length direction of the air duct, so that an aperture of the first branch duct is gradually increased along the air flow direction.

3. The hanging neck fan according to claim 2, wherein the air duct further comprises a second branch duct, and the second branch duct is provided in the side shells, located on an inner side of the air duct and communicated with the air duct, the second branch duct is provided with a second branch duct outlet port that guides the airflow direction to an inner side;

the second branch duct comprises a rear wall extending along the length direction of the air duct, so that an aperture of the second branch duct is gradually increased along the air flow direction.

4. The hanging neck fan according to claim 3, wherein the first branch duct and the second branch duct are both provided at one end of the air duct that is close to the fan.

5. The hanging neck fan according to claim 3, wherein the first branch duct and second branch duct are integrated with the air duct, a connection between the first branch duct and the air duct is a rounded transition structure;

an air guide protrusion extending towards an interior of the air duct is provided at a connection between the rear side wall of the second branch duct and the interior of the air duct;

the air guide protrusion is extended along an extension direction of the rear side wall of the second branch duct, the air guide protrusion and the rear side wall of the second branch duct are connected by a smooth transition structure.

6. The hanging neck fan according to claim 3, wherein an end face of the first branch duct outlet port abuts against an upper inner wall side of the side shells, an end face of the second branch duct outlet port abuts against an inner side wall of the side shells;

the end face of the first air outlet ports of the air duct abuts against a lower inner side wall of the side shells.

7. The neck hanging fan according to claim 1, wherein the air duct comprises an upper side wall and a lower side wall respectively located on an upper side and a lower side of the air duct, the lower side wall is arranged parallel to an inner wall of the neck wearing bracket, and the upper side wall is inclined relieve to an inner wall of the side shells, a distance between the upper side wall and the lower side wall is gradually decreased along the airflow direction inside the air duct so as to achieve a gradual reduction in the internal aperture of the air duct along its internal airflow direction;

a distance between the upper side wall and the upper inner wall of the side shells is gradually increased from one side close to the fan to one side away from the fan so as to form a cavity, and a battery is provided in the cavity.

8. The hanging neck fan according to claim 1, wherein a lower end of the air duct is provided with an air outlet groove extending along its length direction, a plurality of spaced guide vanes are provided in the air outlet groove, and the guide vanes divide the air outlet groove into a plurality of spaced first air outlet ports;

the guide vanes are inclined, and an included angle between the guide vanes and a horizontal plane is 55-60 degrees.

9. The hanging neck fan according to claim 1, wherein the rear shell is hollow, and an interior of the rear shell is provided with a baffle extending along its length direction, and the baffle divides an inner cavity of the rear shell into an upper cavity and a lower cavity, the second air outlet port of the air duct is aligned with the lower cavity and supplies air to the lower cavity, and the rear air outlet is communicated to the lower cavity;

an aperture at a tail end of the lower cavity along the airflow direction is smaller than an aperture at a beginning end of the lower cavity along the airflow direction.

10. A neck hanging fan, comprising:

a neck wearing bracket, which is in an arc shape to fit around a user's neck; two ends of the neck wearing bracket are provided with air inlet ports; the neck wearing bracket at least comprises side shells located on left and right sides and a rear shell located on a rear side, wherein the rear shell comprises a rear air outlet;

a fan, which is provided at the air inlet ports at an end of the side shells; the fan comprises an outer shell extending along a length direction of the end of the side shells and fan blades provided in the outer shell;

an outer side of the outer shell is sleeved with a shock absorber sleeve, and the shock absorber sleeve is fixed in the neck wearing bracket and configured for shock-absorbing the fan;

an air duct, which is provided in the side shells and is extended along a length direction of the side shells; an internal aperture cross-section of the air duct is gradually decreased from one side close to the fan to one side away from the fan; the air duct is communicated to the fan and configured to guide airflow generated by the fan;

the air duct comprises a plurality of first air outlet ports provided along the length direction of the side shells, and a side air outlet corresponding to the first air outlet ports is provided on a wall of the side shells; a part of the airflow blows out of the neck wearing bracket through the first air outlet ports and the side air outlet;

the air duct further comprises a second air outlet port provided at a tail end, and the second air outlet port is aligned with the rear shell, a part of the airflow blows out of the neck wearing bracket through the second air outlet port and the rear air outlet.

11. The hanging neck fan according to claim 10, wherein one end of the shock absorber sleeve close to the air duct is provided with a ring-shaped connection part extending towards the air duct side, and an end of the air duct is sleeved on the ring-shaped connection part and abuts against an end of the shock absorber sleeve.

12. The hanging neck fan according to claim 10, wherein an outer wall of the shock absorber sleeve is provided with a plurality of annular protrusions uniformly spaced along an axial direction of the shock absorber sleeve.

13. The neck hanging fan according to claim 10, wherein the shock absorber sleeve is provided with a C-shaped fixing ring, the fixing ring is sleeved on an outer side of the shock absorber sleeve, and the fixing ring is fixedly connected to the neck wearing bracket to fix the shock absorber sleeve and the neck wearing bracket.

14. The hanging neck fan according to claim 10, wherein the side shells are composed of two outer shells that are matched with each other, and the two outer shells clamp and fix the shock absorber sleeve.

15. A neck hanging fan, comprising:

a neck wearing bracket, which is in an arc shape to fit around a user's neck; two ends of the neck wearing bracket are provided with air inlet port ports; the neck wearing bracket at least comprises side shells located on left and right sides and a rear shell located on a rear side, wherein the rear shell comprises a rear air outlet;

a fan, which is provided at the air inlet ports at an end of the side shells; the fan comprises an outer shell extending along a length direction of the end of the side shells and fan blades provided in the outer shell;

an inlet-and-outlet direction of the fan refers to a length direction of the side shells or a rotation axis of the fan pointing towards a front end of the side shells; the outer shell is provided with a grille component;

an air duct, which is provided in the side shells and is extended along the length direction of the side shells; an internal aperture cross-section of the air duct is gradually decreased from one side close to the fan to one side away from the fan; the air duct is communicated to the fan and configured to guide airflow generated by the fan the air duct comprises a plurality of first air outlet ports provided along the length direction of the side shells, and a side air outlet corresponding to the first air outlet ports is provided on a wall of the side shells; a part of the airflow blows out of the neck wearing bracket through the first air outlet ports and the side air outlet;

the air duct further comprises a second air outlet port provided at a tail end, the second air outlet port is aligned with the rear shell, a part of the airflow blows out of the neck wearing bracket through the second air outlet port and the rear air outlet.

16. The hanging neck fan according to claim 15, wherein the grille assembly comprises a first grille and a second grille that are arranged coaxially, the first grille is provided with a plurality of first guide vanes, the second grille is provided with a plurality of second guide vanes, the first guide vanes and the second guide vanes are arranged in a staggered manner along an axial direction.

17. The hanging neck fan according to claim 16, wherein the number of first guide vanes is less than the number of the second guide vanes, a distance between adjacent two first guide vanes is greater than a distance between adjacent two second guide vanes;

an extension direction of the first guide vanes is in a straight line, and the first guide vanes are inclined in the axial direction;

an extension direction of the second guide vanes is curved, and the second guide vanes are parallel to the axial direction.

18. The hanging neck fan according to claim 16, wherein the first grille is closer to the fan than the second grille, the second grille is closer to the air duct than the first grille, and a hemisphere extending towards one side of the air duct is provided at a center of the second grille.

* * * * *